US008220668B2

(12) United States Patent
Cadden et al.

(10) Patent No.: US 8,220,668 B2
(45) Date of Patent: Jul. 17, 2012

(54) CARTRIDGE DISPENSER

(75) Inventors: Stephen Cadden, Glasgow (GB); Campbell Wallace, Glasgow (GB)

(73) Assignee: Artex-Rawplug Limited, Glasgow (GB)

( * ) Notice: Subject to any disclaimer, the term of this patent is extended or adjusted under 35 U.S.C. 154(b) by 605 days.

(21) Appl. No.: 12/349,235

(22) Filed: Jan. 6, 2009

(65) Prior Publication Data

US 2009/0302055 A1 Dec. 10, 2009

Related U.S. Application Data

(63) Continuation of application No. 12/067,521, filed as application No. PCT/GB2006/003258 on Sep. 4, 2006, now abandoned.

(30) Foreign Application Priority Data

Sep. 3, 2005 (GB) ..... 0517927.0
Sep. 7, 2005 (GB) ..... 0518154.0
Sep. 17, 2005 (GB) ..... 0519043.4

(51) Int. Cl.
*B67D 5/00* (2006.01)

(52) U.S. Cl. ..... 222/326; 222/541.3; 222/145.6; 222/391; 222/567; 222/105

(58) Field of Classification Search ..... 222/145.6, 222/325, 326, 391, 541.3, 95; 285/23, 24, 285/27; 403/12
See application file for complete search history.

(56) References Cited

U.S. PATENT DOCUMENTS

| | | | | | |
|---|---|---|---|---|---|
| 4,869,400 | A * | 9/1989 | Jacobs | 222/137 |
| 5,018,768 | A * | 5/1991 | Palatchy | 285/24 |
| 5,184,757 | A * | 2/1993 | Giannuzzi | 222/82 |
| 5,263,614 | A * | 11/1993 | Jacobsen et al. | 222/137 |
| 5,944,226 | A * | 8/1999 | Schiltz et al. | 222/137 |
| 6,311,871 | B1 * | 11/2001 | Binder | 222/145.6 |
| 6,371,938 | B1 * | 4/2002 | Reilly et al. | 604/131 |
| 6,921,384 | B2 * | 7/2005 | Reilly et al. | 604/131 |
| 7,775,399 | B2 * | 8/2010 | Wood | 222/94 |
| 8,028,857 | B2 * | 10/2011 | Rasmussen | 222/1 |
| 2005/0139616 | A1 | 6/2005 | Ichikawa et al. | |
| 2006/0151531 | A1 * | 7/2006 | Tikusis | 222/145.6 |

FOREIGN PATENT DOCUMENTS

| | | | |
|---|---|---|---|
| DE | 19744746 | | 4/1999 |
| EP | 441538 | * | 8/1991 |
| WO | WO2004076078 | * | 2/2004 |

* cited by examiner

*Primary Examiner* — Kevin P Shaver
*Assistant Examiner* — Donnell Long
(74) *Attorney, Agent, or Firm* — Gifford, Krass, Sprinkle, Anderson & Citkowski, P.C.

(57) ABSTRACT

An apparatus is provided for storing and dispensing a product. The apparatus includes a rigid outer casing adapted to receive a cartridge that is partially covered with a support membrane and has a weakened area capable of rupturing when pressure is applied to the cartridge. The support membrane extends over the weakened area and bursts as the cartridge expands into an expansion chamber or the weakened area ruptures. The support membrane provides support to the front end of the cartridge and resistance during insertion of the cartridge so that the cartridge is 'primed' and ready to dispense its contents by a user when necessary.

14 Claims, 26 Drawing Sheets

CARTRIDGE DISPENSER

CROSS-REFERENCE TO RELATED APPLICATIONS

This application is a continuation of U.S. patent application Ser. No. 12/067,521 filed on Mar. 20, 2008, which is the U.S. national phase of PCT/GB2006/003258 filed Sep. 4, 2006, which claims priority of GB 0517927.0 filed Sep. 3, 2005, GB 0518154.0 filed Sep. 7, 2005, and GB 0519043.4 filed Sep. 17, 2005.

FIELD OF THE INVENTION

The present invention relates to apparatus for the storing and dispensing of products. In particular, the present invention relates to apparatus for facilitating the removal of a dispensed cartridge and preventing contamination of a casing containing the cartridge.

BACKGROUND OF THE INVENTION

Dispensing apparatus in the form of cartridges is well-known in the art. In these previous types of dispensing apparatus, it can be problematic to remove a dispensed cartridge. In some instances, this leads to a casing which encloses the cartridge becoming accidentally covered in material to be dispensed. Previous dispensing apparatus therefore have inefficient and unsatisfactory methods for the removal of a dispensed cartridge. This leads to spillage which needs to be cleared and also wastes material.

It is an object of at least one aspect of the present invention to obviate or mitigate at least one or more of the aforementioned problems.

It is a further object of at least one aspect of the present invention to provide dispensing apparatus which facilitates the removal of a dispensed cartridge.

It is a yet further object of at least one aspect of the present invention to provide dispensing apparatus which facilitates the removal of a dispensed cartridge and substantially eliminates spillage of any material onto a casing.

It is a further object of the present invention to provide dispensing apparatus which comprises a piston retention means.

SUMMARY OF THE INVENTION

According to a first aspect of the present invention there is provided apparatus for storing and dispensing a product, the apparatus comprising:

a cartridge;

a substantially rigid outer casing;

a nozzle;

a locking member capable of attaching the nozzle to the substantially rigid outer casing;

wherein the substantially rigid outer casing is adapted to receive the cartridge and the cartridge comprises a weakened area capable of rupturing when pressure is applied to the cartridge.

On rupturing of the weakened area, the total contents of the cartridge may be dispensed.

The cartridge may be 'sausage-like' in shape and may be formed in any suitable extrusion apparatus such as an adapted edible sausage-making apparatus.

The cartridge may be made from thin, flexible film with a high tear strength. The film may have a thickness of about 0.01 mm to about 0.1 mm. The cartridge may be made from any suitable plastics material such as polyethylene. Alternatively, the cartridge may be made from a metal/alloy foil.

Typically, the material forming the cartridge is not too elastic. If the material is too elastic, the apparatus will not function properly.

The material forming the cartridge may also be chosen so that it is not reactive and/or does not deteriorate on contact with the contained compounds.

Typically, the cartridge may comprise a single chamber or alternatively, at least two chambers or any number such as a plurality of chambers. The different chambers may contain different compounds which are intended to be mixed. The chambers may be of different volumes and may therefore contain different amounts of the different compounds. For example, the volume in a first chamber may be 40 percent and the volume in a second chamber may be 60 percent of the whole cartridge, the volume in the first chamber may be 20 percent and the volume in the second chamber may be 80 percent of the whole cartridge; and the volume in the first chamber may be 10 percent and the volume in the second chamber may be 90 percent of the whole cartridge.

Conveniently, on initial formation, the cartridge may have two open ends. Once the compound or compounds are extruded into the chamber or separate chambers of the cartridge, the ends of the cartridge may be sealed with any suitable sealing means. The seal for the end of the cartridge which is intended to rupture may be made weaker than a seal at the other end of the cartridge. The sealing means may comprise a sealing clip which may be releasable under pressure. Alternatively, any other suitable sealing means such as crimping, gluing, heat sealing or any form of cap or tie may also be used.

Preferably, on release of the sealing means the content of the cartridge may be dispensed. Additionally, when the cartridge contains different components, the components may mix substantially simultaneously on release of the sealing means. This occurs as the single sealing means, seals all of the contents of the cartridge. The mixing may occur immediately thereby substantially simultaneously mixing the different components. An efficient mix may therefore be obtained.

Preferably, the substantially rigid outer casing may be a hollow cylindrical member made from any suitable plastics, metal or alloy material. The outer casing may have an inner cylindrical section which may be of constant diameter from one end to the other. Alternatively, the cylindrical member at one end may have a reduced diameter.

Typically, the outer casing is adapted to receive the cartridge and form a snug fit with the outer walls of the cartridge. The distance between the outer casing and the cartridge may be about 1-10 mm or preferably about 5 mm. This may prevent radial expansion (i.e. widening) on application of pressure to an end of the cartridge.

Conveniently, pressure may be applied to one end of the flexible cartridge by any suitable means such as any type of dispensing gun. The pressure may be applied manually or via a pneumatic piston. Typically, the dispensing gun may be a standard mastic gun as found in many DIY stores. Alternatively, any type of syringe-like plunger or screw-like plunger may be used.

The nozzle may comprise an expansion chamber into which the cartridge may at least partially expand into. The apparatus may be adapted so that on application of pressure to one end of the cartridge, expansion in the radial direction is prevented so that at the opposite end to which the pressure is applied, the cartridge may be deformed and form a 'bulbous' region due to hydrostatic pressure built up in the cartridge. As hydrostatic pressure is built up in the cartridge, a critical point is reached at which the sealing means on the cartridge at the opposite end to which the pressure is being applied ruptures thereby allowing the contents of the cartridge to be dispensed. The nozzle may comprise any suitable size and shape of expansion chamber appropriate for the cartridge to partially expand into. For example, the expansion chamber may be substantially conical in shape.

Typically, the nozzle has an annular section which fits inside one end of the casing. The casing may comprise a recessed portion which may be substantially annular in shape adapted to receive the annular section of the nozzle. The nozzle may therefore partially insert into the casing and be attached, for example, via a snap-fit arrangement. The nozzle may therefore fit snugly inside the casing.

Typically, the nozzle may comprise reaction shoulders, for example, in the form of a flat annular section in a ring-form. The flat annular section may extend substantially all of the way around the inside of the nozzle or at least part of the way around. The reaction shoulders may abut and prevent the cartridge from moving further along the longitudinal length of the outer casing as pressure is applied. At least one or a plurality of reaction shoulders may be formed. The reaction shoulders may be adapted to the shape of the cartridge and may be of any suitable shape. For example, the reaction shoulders may be substantially planar or substantially concave. The reaction shoulders may be substantially perpendicular to the longitudinal length of the cartridge. The actual surface contact area between the reaction shoulder and the cartridge may be specifically chosen. If there is too much surface contact between the reaction shoulder and the cartridge, too much pressure may be needed to be applied to remove the sealing means from the cartridge and the material forming the cartridge may rupture at any specific point meaning that different compounds in the different chambers may not mix. Alternatively, if there is too little surface contact between the reaction shoulders and the cartridge, the cartridge may be pushed through the outer casing without the sealing means rupturing.

The expansion chamber may be formed integrally in the nozzle or may be formed from a separate member such as a separate adaptor unit which may be placed in the outer casing or inside the nozzle.

The nozzle may comprise an integral mixer unit which further aids the mixing of different products in the cartridge. Alternatively, the mixer unit may be a separate item and may be inserted into the nozzle. Preferably, the diameter of the nozzle is wide enough to prevent blockage on release of the sealing means.

The nozzle may also comprise means for catching the sealing means such as a cross-member. The cross-member may be attached to the mixer unit or may be integrally formed at the entrance to the nozzle.

The nozzle may form a tight, snug fit with the end of the outer casing. For example, a snap-fit arrangement may be used. However, to further secure the nozzle to the casing, it is preferred to have a locking member to further secure this attachment. Any suitable type of locking member may be used. For example, a locking member in the form of, for example, a nut with an inner thread may be screwed onto a thread at the top end of the casing. The locking member may abut and engage against at least part of the nozzle, securing it in place. The locking member may also be formed to comprise protruding members on its outer surface to facilitate a user gripping the locking member.

In alternative embodiments, the locking member may be a snap-fit arrangement which at least partially attaches over the outer casing. The locking member may be in a substantially horse-shoe or 'U'-shaped arrangement which clips over the outer surface of the casing. It is preferred that tie locking member extends around more than 180°, 200°, 220°, 240°, 260°, 280°, or 300° so that the locking member may snap and/or attach onto a recess such as a groove extending around or at least partially around a top end of the casing. The locking member may comprise any suitable type of engagement member to securely attach the nozzle to the casing. For example, any form of protruding member or fastening member may be used to attach the nozzle onto the casing. The protruding member may form a structure with a substantially or slightly smaller diameter than a groove formed on the casing. In this type of embodiment, the protruding member may tightly grip the groove due to a difference in diameter. The locking member may be adapted to prevent springing off on application of pressure to the cartridge. To provide further strength to the locking member, strengthening ribs may be applied to any portion such as the top portion of the locking member. The strengthening ribs may therefore prevent deflection and/or distortion of the restraining clip on application of pressure from a dispensing gun.

Advantageously, on dispensing of material from a cartridge, the locking members may be either unscrewed such as the locking member in the form of a nut or simply clipped and/or forced off using the snap-fit arrangement by applying pressure in the correct direction. On removal of the locking member, the nozzle may be removed by applying some pulling pressure to the nozzle. This has the advantage that no spillage is formed on the inside surface of the casing. This is advantageous, otherwise, the inside of the casing would have to be cleaned every time a change of nozzle was required. Furthermore, it is possible to only partially dispense a cartridge and then reuse the apparatus at a later date. A replacement nozzle may then be fitted and the remaining material be dispensed. The apparatus is therefore reusable due to the ability to prevent dispensed material forming on the inside of the casing. During the replacement of the nozzle, the inside surface of the casing remains free from contamination and spillage. This is a specific advantage over prior art apparatus.

A further specific advantage of the apparatus, is that in the event that the contents of the cartridge have been fully dispensed, the film forming the cartridge may be substantially compressed into a recess in the nozzle. On removal of the nozzle, the compressed film remains attached to the nozzle thereby allowing easy removal. This process also prevents any spillage occurring on the inside of the casing.

Preferably, the sealing means may be formed from any metal or plastics material such as soft aluminium or steel wire which is wound around the ends of the cartridge. The sealing means is not attached too tightly or too strongly as this will prevent the release of the sealing means on application of pressure to the cartridge. It is also preferred that any sharp ends formed by the sealing means may be pointed away from the flexible cartridge thereby preventing any possible piercing of the cartridge.

Typically, the apparatus may be used to provide dispensed products for use in chemical anchors, sealants, food processing and medical applications. The uses of chemical anchors includes securing bolts in concrete/masonry, forming a stud socket and post-installed rebar connections.

Compounds which are intended to be mixed may include any suitable resins, epoxies, polyesters and vinylesters.

According to a second aspect of the present invention, there is provided a method for dispensing a product, the method comprising:

inserting a cartridge which comprises a weakened area into a substantially rigid outer casing which is adapted to receive the cartridge;

at least partially inserting a nozzle into the substantially rigid outer casing;

substantially securely attaching the nozzle using a locking member; and applying pressure to the cartridge and thereby increasing the pressure within the cartridge to a point where said weakened area ruptures enabling the contents of the cartridge to be dispensed.

Typically, the cartridge comprises a single chamber, at least two chambers or a plurality of chambers containing different compounds.

Preferably, on rupturing the weakened area, different compounds from the cartridge may be substantially simultaneously mixed.

Typically, the nozzle may comprise an expansion chamber into which the cartridge may partially expand into prior to the weakened area rupturing and allowing the contents of the cartridge to be dispensed and mixed if necessary.

Any suitable type of locking member may be used. For example, a nut type arrangement which fits over the top of the nozzle may be used by attaching via a screw thread onto the top of the casing. Alternatively, a snap-fit member may be used to partially extend around the casing and extend over at least part of the nozzle. The snap-fit member may comprise at least one protruding member which is adapted to be received into at least one groove on the casing.

Once at least part of the contents have been dispensed, the locking member may be removed and the nozzle pulled free from the casing.

In embodiments where the cartridge has been fully dispensed, on removal of the nozzle, a film forming the cartridge is substantially compressed in the nozzle thereby enabling clean and easy removal of the cartridge. This prevents any mess from forming on the inside surface of the casing.

According to a third aspect of the present invention, there is provided a kit comprising:

a cartridge comprising at least one weakened area capable of rupturing on application of pressure to the cartridge;

a substantially rigid outer casing which is adapted to receive the cartridge;

a nozzle;

a locking member capable of attaching a nozzle to the substantially rigid outer casing; and a dispensing gun.

Preferably, the dispensing gun may be a standard mastic gun.

Preferably, the kit may be used to substantially simultaneously mix different compounds.

According to a fourth aspect of the present invention there is provided apparatus for storing and dispensing a product, the apparatus comprising:

a casing; and a protruding member located on said casing;

wherein said protruding member is capable of engaging and acting as a stop to prevent a piston member from falling out.

Preferably, the protruding member may be substantially inward directed i.e. towards the centre of the casing.

Typically, the protruding member may be of any suitable shape which is capable of engaging and/or snagging the piston member and thereby preventing the piston member from falling out of the casing. Typically, the protruding member may be substantially concave shaped or alternatively may be substantially linear in shape.

Typically, there may be at least one protruding member or, for example, two to ten protruding members. Alternatively, there may be a plurality of protruding members.

Typically, the casing may be substantially cylindrical in shape and the protruding member may be located at substantially one end of the casing. The protruding member may be located at the end opposite to the end of the casing where the products contained in a cartridge may be dispensed.

The protruding member may extend at least part of the way around an end portion of the casing which may be substantially cylindrical in shape. Typically, the protruding member may extend around about 20 to 70% of the end of the casing. Preferably, the protruding member may extend substantially all of the way around the casing. Most preferably, the protruding member may extend all of the way around the end of the casing which may be substantially cylindrical in shape.

Conveniently, the protruding member may be integral with the main body of the casing. Alternatively, the protruding member may be formed separately and attached using any suitable means such as adhesive.

Typically, the length of the protruding member measured along the longitudinal axis of the casing may be about 0.1 to 5 cm, about 0.2 to 2 cm, about 0.3 to 1 cm or about 0.7 cm.

Typically, measuring along the longitudinal axis of the casing, the protruding member extends inwardly by about 10 to 70° or preferably about 30°.

Typically, the protruding member reduces the diameter in that part of the casing by about 5 to 20% or about 10%. The protruding member may reduce the diameter of the casing by about 0.1 to 2 cm, about 0.2 to 1 cm, or about 0.5 cm. For example, the diameter of the casing at a mid-portion of the casing may be about 5 cm and the reduced diameter formed by the protruding member may be about 4.5 cm.

Typically, the casing may be formed from any suitable plastics material. The protruding member may be integrally formed with the casing and may therefore also be formed from any suitable plastics material. To enhance the ability of the protruding member to prevent the piston from falling out of the casing, a high friction material such as a rubber-like material (e.g. silicone rubber) may be provided on the inner surface of the protruding member to increase the ability of the protruding member to engage with the piston. Alternatively, the protruding member may comprise teeth or any other suitable type of engaging member to act as a stop against the piston.

The protruding member which extends around the end of the casing may be formed by any suitable method. For example, in the embodiment where the protruding member extends all the way around the end of the casing, the protruding member may be formed by applying pressure to the end of a substantially cylindrical casing to, in effect, crimp the end of the casing inwardly. This process may occur on a carousel arrangement during the formation of the casing. In a further alternative embodiment, the protruding member may be formed using any suitable pressure method or heat application process.

Typically, any suitable form of dispensing gun such as a standard mastic gun as available from DIY stores may be used to extrude material contained within a cartridge located in the casing.

In a particular embodiment, a sausage-like member in the form of a cartridge may be contained within the casing. We refer to WO 2004/076078 which is incorporated herein by reference. The cartridge may contain a plurality of different chambers, each different chamber containing different compounds which are intended to be mixed. Typically, the different contents of the cartridge may be sealed within separate chambers within the cartridge by a single sealing means such as crimping, gluing, heat sealing or any form of cap or tie. In particular, the sealing means may comprise a sealing clip formed from any suitable type of metal or alloy which is releasable under pressure thereby enabling the different contents of the cartridge to be substantially simultaneously mixed. Prior to the sealing means rupturing and enabling the different contents of the cartridge to mix, the cartridge may partially expand into an expansion chamber formed at an end of the casing. This allows hydrostatic pressure to build up at one end of the cartridge, eventually forcing the sealing clip off and allowing the dispensing and mixing to occur.

According to a fifth aspect of the present invention, there is provided a method for retaining a piston member within a casing used for storing and dispensing a product, said method comprising:

providing at least one protruding member on a casing, said at least one protruding member adapted to engage with at least part of a piston member;

wherein said at least one protruding member may engage with and act as a stop to prevent the piston member from falling out of the casing.

Typically, there may be any number of protruding members. For example, there may be a plurality of protruding members or two to ten protruding members.

In particular, at least part of the piston member may have a diameter larger than the diameter formed in the casing by the at least one protruding member. Typically, the part of the piston member which has a slightly larger diameter than the diameter formed by the protruding member, may engage with the protruding member thereby preventing the piston member from falling out of the casing.

According to a sixth aspect of the present invention, there is provided a kit comprising:

apparatus according to the fourth aspect; and a dispensing gun.

Typically, the kit may also comprise a nozzle for attachment to the casing to facilitate the dispensing.

According to a seventh aspect of the present invention there is provided apparatus for storing and dispensing a product, the apparatus comprising:

a cartridge at least partially covered with a support membrane; and a substantially rigid outer casing;

wherein the substantially rigid outer casing is adapted to receive the cartridge at least partially covered with the support membrane, and the cartridge comprises a weakened area capable of rupturing when pressure is applied to the cartridge.

On rupturing of the weakened area, the total content(s) of the cartridge may be dispensed.

The support membrane may extend over the weakened area of the cartridge which is intended to rupture. Typically, the support membrane may extend partially down the sides of the cartridge. The support membrane may extend down at least one or both sides of the cartridge by about 50-200 mm; about 75-125 mm; or about 100 mm.

The support membrane may extend about 20%, about 40%, about 60% or about 80% of the way down at least one or both sides of the cartridge. Alternatively, the support member may form a full cover in the form of a jacket over the cartridge.

The sides of the support membrane may fully extend around the perimeter of the cartridge or may only extend partially around the perimeter. It is preferred that the support membrane extends at least 50% of the way around the perimeter of the cartridge.

Typically, the support membrane may be formed from a sheet of material which may be simply folded and/or crimped over an end of the cartridge. Alternatively, the support membrane may be in the form of a substantially tubular jacket into which the cartridge may be partially for fully inserted. The support membrane therefore remains secured on insertion of the cartridge into the casing.

Conveniently, the support membrane may rupture and/or burst as the cartridge partially expands into an expansion chamber and/or the weakened area ruptures.

The support membrane may be formed from any suitable material which may have a relatively low tear resistance and/or low tear strength.

The support membrane may be substantially inelastic and may be formed from any suitable woven or non-woven material such as a fibrous material with oriented fibres. The fibres may be relatively short to provide a low tear resistance and/or tear strength. For example, any suitable fabric or paper-like material may be used such as commonly used toilet paper or kitchen roll paper. The support membrane may also be a laminated structure.

The support membrane may also have some form of absorbance capability. This provides the advantageous facility that if any of the contents of the cartridge leak out, this leakage will be absorbed by the support membrane.

The support membrane may have a thickness of about 0.01 mm to 2 mm; about 0.05 mm to 1 mm; about 0.1 mm to 0.5 mm; or about 0.2 mm.

The distance between the inner surface of the casing and the part of the membrane covered with the support membrane may be about 0.01 to 0.2 mm, about 0.1 m or about 0.05 mm.

The thickness of the support membrane may be adapted so that the inner diameter of the casing may be substantially filled by the cartridge covered with the support membrane. For example, in an embodiment where the rigid outer casing has an inner diameter of 47 mm and thickness of the cartridge is 46.5 mm, then it is advantageous that the support membrane may have a thickness of about 0.2 mm. As the support membrane is on both sides of the cartridge, the total diameter formed by the cartridge and support membrane may be about 46.9 mm which forms a snug fit in the rigid outer casing. This snug fit allows the cartridge to become pressurised (i.e. primed) and therefore ready for use.

Typically, the function of the support membrane may be that as the cartridge is inserted into the substantially rigid outer casing, the support member may provide some resistance due to interference and/or crimping between the support member and the inside surface of the rigid casing. Due to the pressure applied to the end of the cartridge during insertion, hydrostatic pressure may be built up inside the cartridge. The cartridge may therefore be seen as being 'primed' and ready to dispense its contents by a user when necessary. Typically, the support membrane may be chosen so that there is not too much resistance as the cartridge is inserted into the substantially rigid outer casing. If the resistance is too high, this causes manufacturing difficulties. The tear strength of the support membrane may be chosen so that the support membrane does not impede the release of the contents of the cartridge via the weakened area or impede the release of sealing means an the cartridge.

The support membrane may also provide a degree of support to the front end of the cartridge thereby preventing the cartridge from creeping and extending into an expansion chamber in the cartridge during transit or storage.

Additionally, the support membrane may prevent a user from viewing sealing means such as a clip which may be used to seal the contents of the cartridge. In use, it has been found that some users try and remove the sealing means, such as clips, using pliers rather than using hydrostatic pressure to force the clip off. This incorrect use by a user is found even though clear instructions are provided with the apparatus.

The cartridge may be made from thin, flexible film with a high tear strength. The cartridge may be made form any suitable plastics material such as polyethylene. Alternatively, the cartridge may be made from a metal/alloy foil.

Typically, the material forming the cartridge is not too elastic. If the material is too elastic, the apparatus will not function properly.

The material forming the cartridge and support membrane may also be chosen so that it does react and/or deteriorate on contact with the contained compounds.

Typically, the cartridge may comprise a single or a plurality of separate chambers and, in particular, at least two chambers. The different chambers may contain different compounds which are intended to be mixed. The chambers may be of different volumes and may therefore contain different amounts of the different compounds. For example, the volume in a first chamber may be about 40% of the whole cartridge and the second chamber may be about 60% of the whole cartridge; the volume in the first chamber may be about 20% of the whole cartridge and the volume chamber may be about 80% of the whole cartridge; or the volume in the first chamber may be about 10% of the whole cartridge and the volume in the second chamber may be about 90% of the whole cartridge.

Conveniently, on initial formation, the cartridge may have two open ends. Once the compound or compounds are extruded into the chamber or separate chambers of the cartridge, the ends of the cartridge may be sealed with any suitable sealing means. The seal for the end of the cartridge which is intended to rupture may be made weaker than a seal at the other end of the cartridge. The sealing means may comprise a sealing clip which may be releasable under pressure. Alternatively, any other suitable sealing means such as crimping, gluing, heat sealing or any form of cap or tie may also be used.

Preferably, on release of the sealing means different contents of the cartridge may mix substantially simultaneously together. This occurs as the single sealing means, seals all of the contents of the cartridge. The mixing may occur immediately meaning that an efficient mix may be obtained.

Preferably, the substantially rigid outer casing may be a hollow cylindrical member made from any suitable plastics, metal or alloy material. The outer casing may have an inner cylindrical section which may be of substantially constant diameter from one to the other. Alternatively, the cylindrical member at one end may have a reduced diameter.

Typically, the outer casing is adapted to receive the cartridge which is at least partially covered with a support member. The casing forms a snug fit with the outer walls formed by the cartridge which is at least partially covered with the support membrane. Preferably, the portion of the cartridge which is at least partially covered with the support membrane is substantially adjacent and abuts against the inner surface of the casing. The casing prevents radial expansion (i.e. widening) on application of pressure to an end of the cartridge.

Conveniently, pressure may be applied to one end of the flexible cartridge by any suitable means such as any type of dispensing gun. The pressure may be applied manually or via a pneumatic piston. Typically, the dispensing gun may be a standard mastic gun as found in many DIY stores. Alternatively, any type of syringe-like plunger or screw-like plunger may be used. Conveniently, there may be an expansion chamber into which the cartridge may partially expand into. The apparatus may be adapted so that on application or pressure to one end of the cartridge, expansion in the radial direction is prevented so that at the opposite end to which the pressure is applied, the cartridge deforms into an expansion chamber.

Preferably, the outer casing comprises integral reaction shoulders which abut and prevent the cartridge from moving further along the longitudinal length of the outer casing as pressure is applied. The reaction shoulders may be adapted to the shape of the cartridge and may be substantially concave. The actual surface contact area between the reaction shoulder and the cartridge may be specifically chosen. If there is too much surface contact between the reaction shoulder and the cartridge, too much pressure will need to be applied to remove the sealing means from the cartridge and the material forming the cartridge may rupture at any specific point meaning that different compounds in the different chambers may not mix. Alternatively, if there is too little surface contact between the reaction shoulders and the cartridge, the cartridge will be pushed through the outer casing without the sealing means rupturing.

In an alternative embodiment, the reaction shoulder may be formed from a separate insert which may be inserted into the outer casing. In a yet further alternative, tie cartridge may be glued to the side of the outer casing thereby preventing movement along the length of the outer casing.

Typically, the expansion chamber may be integrally formed in the outer casing during initial moulding. Alternatively, the expansion chamber may be formed by a separate adaptor unit which may be placed into the outer casing. In a further alternative, the expansion chamber may be contained within a separate nozzle member.

Conveniently, the apparatus comprises a nozzle member which may be fitted to an end of the outer casing via, for example, a screw thread. The nozzle may comprise an integral mixer unit which further aids the mixing of the different products in the flexible cartridge. Alternatively, the mixer unit may be a separate item and may be inserted into the nozzle. Preferably, the diameter of the nozzle may be wide enough to prevent blockage on release of the sealing means.

The nozzle may also comprise means for catching the sealing means such as a cross-member. The cross-member may be attached to the mixer unit or may be integrally formed at the entrance to the nozzle.

Preferably, the sealing means may be formed from any metal or plastics material such as soft aluminium or steel wire which is wound round the ends of the cartridge. The sealing means is not attached too tightly or too strongly as this will prevent the release of the sealing means on application of pressure to the cartridge. It is also preferred that any sharp ends formed by the sealing means may be pointed away from the flexible cartridge thereby preventing any possible piercing of the cartridge.

An advantage of the apparatus is that once the contents of the cartridge are emptied, the emptied cartridge may be removed and replaced with a new cartridge. The apparatus may therefore be reusable. The emptied cartridge may be removed by simply detaching the pressure gun from the cartridge. To facilitate the removal of the emptied cartridge, the outer casing may have a hinged opening to allow a user easy entry.

Preferably, the film forming the cartridge may be adapted so that on expansion into the expansion chamber, the film extends partly into the expansion chamber. This may prevent mixing of different compounds and may therefore prevent any hardening of mixed materials within the apparatus. This may allow the apparatus to be used at a later date without completely emptying the contents of the cartridge.

Typically, the apparatus may be used to provide dispensed products for use in chemical anchors, sealants, food processing and medical applications. Uses of chemical anchors includes securing bolts in concrete/masonry, forming a stud socket and post-installed rebar connections.

Compounds which are intended to be mixed may include any suitable resins, epoxies, polyesters and vinyl esters.

According to an eighth aspect of the present invention, there is provided a method for dispensing a product, the method comprising:

inserting a cartridge which is at least partially covered with a support membrane into a substantially rigid outer casing which is adapted to receive the cartridge, said cartridge also comprising a weakened area; and applying pressure to the cartridge thereby increasing the pressure within the cartridge to a point where said weakened area ruptures enabling the contents of the cartridge to be dispensed.

Conveniently, the support membrane may be substantially inelastic and ruptures and/or bursts an expansion of the cartridge into an expansion chamber.

Typically, the cartridge comprises a plurality of chambers containing different compounds.

Preferably, on rupturing of the weakened area, different compounds in the cartridge may be simultaneously mixed.

According to a ninth aspect of the present invention, there is provided a kit comprising:

a cartridge at least partially covered with a support membrane, said cartridge comprising at least one weakened area capable of rupturing, on application of pressure to the cartridge;

a substantially rigid outer casing which is adapted to receive the cartridge; and a dispensing gun.

Preferably, the dispensing gun may be a standard mastic gun.

Preferably, the kit may be used to simultaneously mix different compounds.

BRIEF DESCRIPTION OF THE DRAWINGS

Embodiments of the present invention will now be described, by way of example only, with reference to the accompanying drawings in which.

DETAILED DESCRIPTION OF THE PREFERRED EMBODIMENTS

Figure 1:
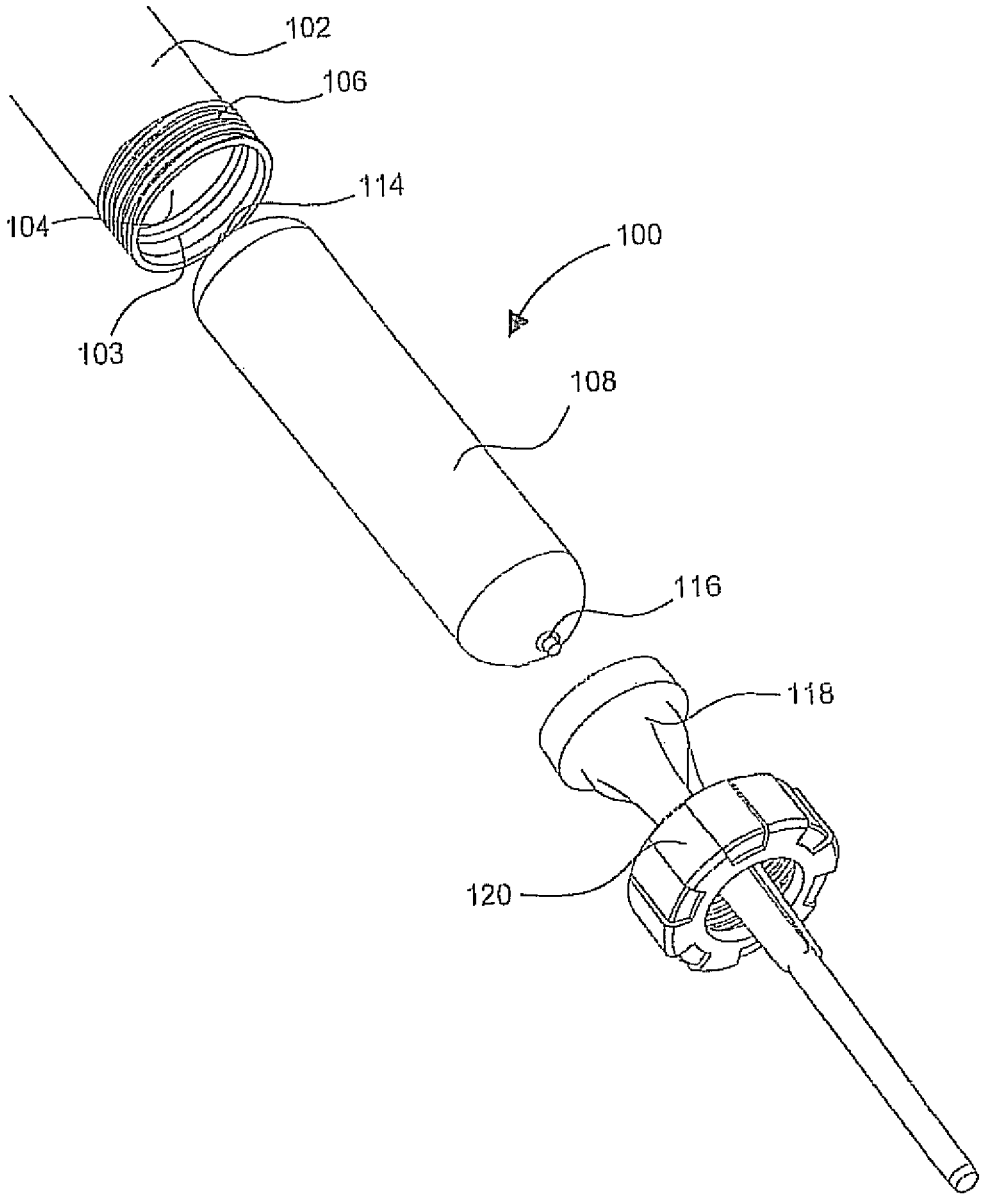
FIG. 1 is a schematic representation of dispensing apparatus according to a first embodiment of the present invention.

Referring to FIG. 1, there is a schematic representation of dispensing apparatus, generally designated 100. The apparatus 100 comprises a substantially rigid cylindrical hollow casing 102, a cartridge 108, a nozzle 118 and a securing nut 120.

The substantially rigid cylindrical hollow casing 102 has an inner surface 104 and a thread 106. On the inner surface 104 of the cylindrical casing there is a recessed substantially cylindrical portion 103. The cylindrical casing 102 is made from any suitable plastics or metal/alloy material. The casing 102 is designed to snugly receive the cartridge 108 and thereby substantially prevent radial expansion on application of pressure to the rear of the cartridge 108.

The cartridge 108 may be described as being 'sausage-like' in shape. The cartridge 108 may comprise a single chamber or two separate chambers 110,112. The separate chambers A,B may be secured to one another via adhesive means in the required 'sausage-like' configuration. Chamber A may contain a first compound and chamber B may contain a second compound. The chambers A,B are sealed separate units.

The cartridge 108 is formed from a thin material which has a limited degree of flexibility. However, the material is not too elastic, otherwise the material will simply stretch on application of pressure. The material also has a high tear strength to prevent the cartridge 108 from inadvertently bursting open. The material is also chosen so as to be inert towards the materials which they contain. The material forming the cartridge 108 may be made from any suitable plastics, polymer or metal foil material.

The ends of the cartridge 108 are closed with clips 114,116 once the cartridge 108 has been filled with the respective compound or compounds. Any suitable type of apparatus is used to form the 'sausage-like' cartridge 108. For example, edible sausage-making apparatus may be used. Clips 114,116 are formed from relatively soft aluminium wire and are wound around the ends of the cartridge 108 to prevent any leakage of compounds contained therein during storage or initial placement in the casing 102. Careful attachment of the clips 114,116 is required so that any sharp ends formed by the clips 114,116 do not pierce the cartridge 108 at any time during use of the dispensing apparatus 100.

Figure 2:
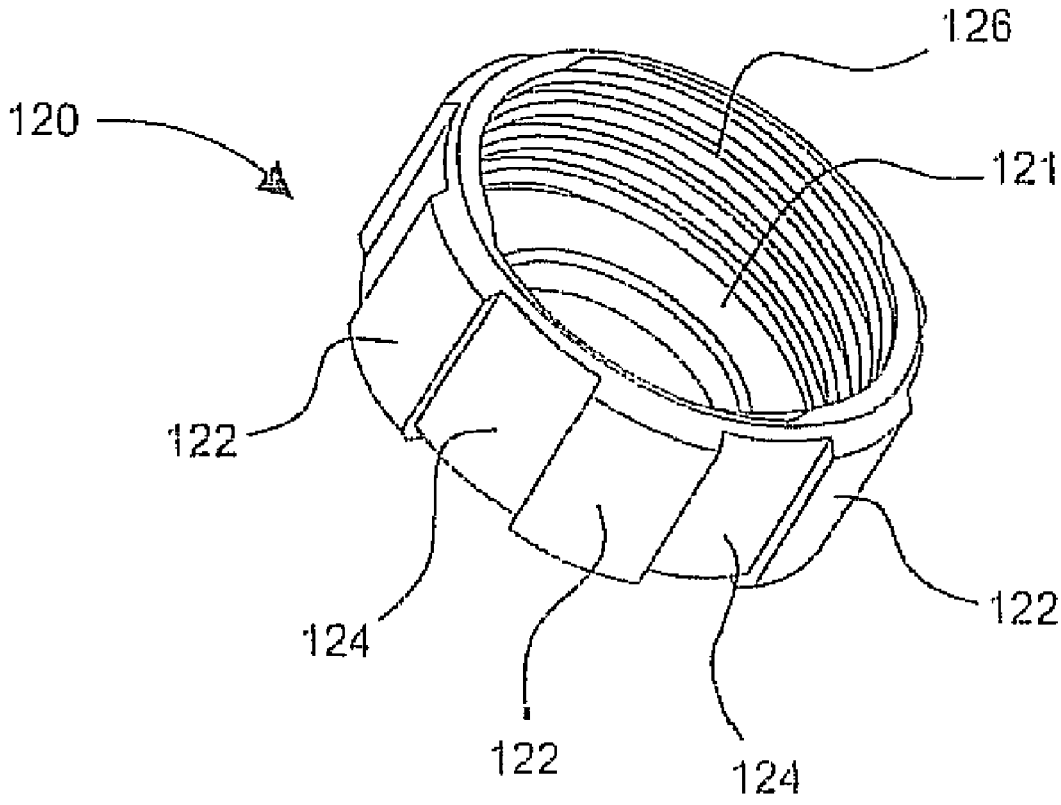
FIG. 2 is a schematic representation of a securing nut as shown in FIG. 1.

FIG. 2 represents the securing nut 120. The securing nut 120 has a thread 126 which is used to securely attach the nozzle 118 to the casing 102. On the top of the securing nut 120 there is a substantially flat annular surface 121 which is adapted to engage and hold the nozzle 118 in place. As shown in FIG. 2 the outer surface of the securing nut 120 comprises alternating protruding segments 122 and indents 124. This helps a user to grip the securing nut 120 and therefore secure and release the securing nut 120 as necessary.

FIGS. 3*a*-3*d* are schematic representations of the nozzle 118. The nozzle 118 comprises a circular inlet 128 and a circular outlet 130. Material is therefore dispensed into inlet 128 and out of outlet 130. At the very top of the nozzle 118 there is a small chamfered edge 136 which facilitates the attachment of the nozzle 118 to the casing 102. There is then a longer shallow tapered section 132 leading on to a flat annular section 133. Tapered sides 138 then reduce the diameter of the nozzle 118 down to a much reduced diameter section forming a main body 144 of the nozzle 118. Within the main body 144 of the nozzle 118 there is a mixing unit 140 which facilitates the mixing of different components contained within the cartridge 108.

Figure 3B:
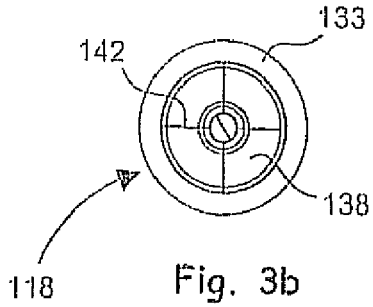
FIGS. 3*a*-3*d* are schematic representations of a nozzle as shown in FIG. 1.
Figure 3A:
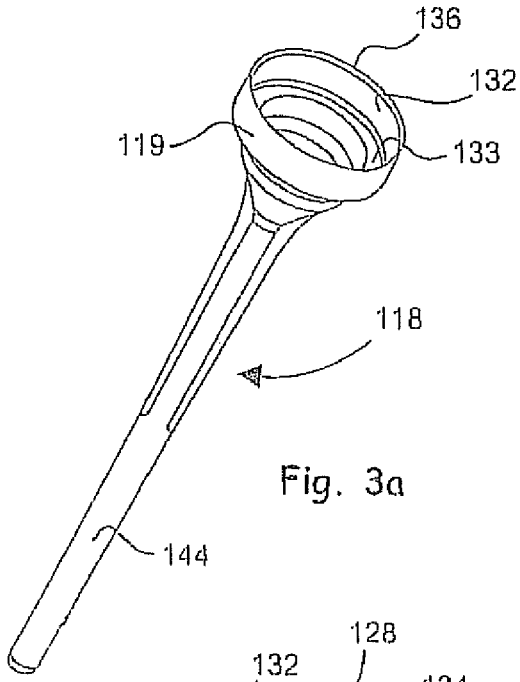
Figure 3C:
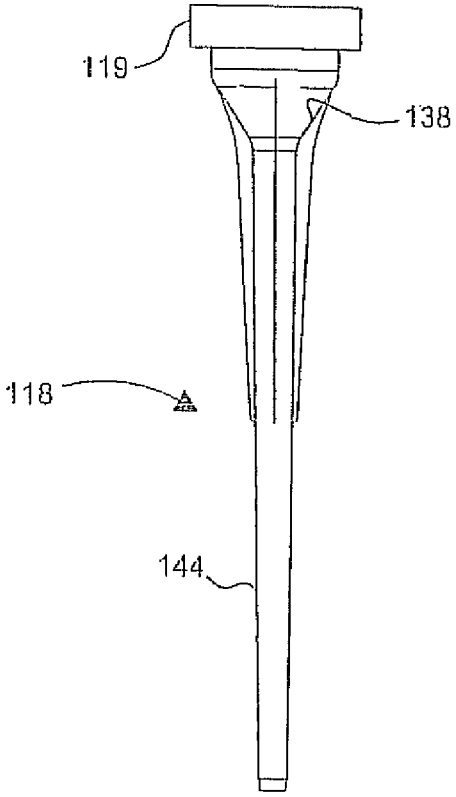
Figure 3D:
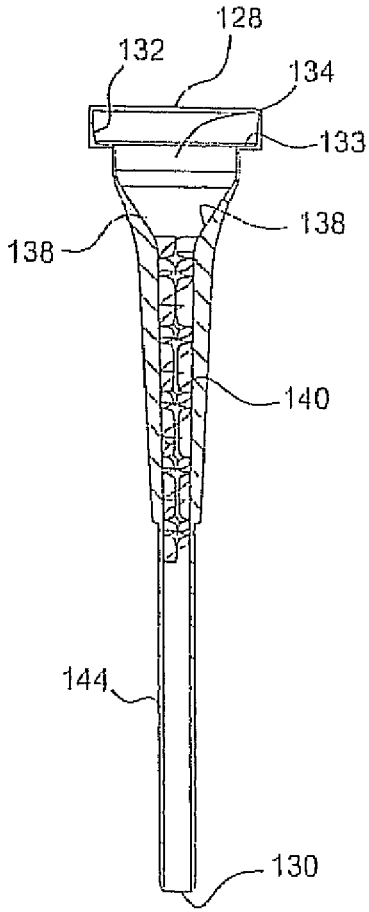

As shown in FIG. 3*b*, there is also a cross-member unit 142 which is used to prevent the clip 116, once removed from the cartridge 108, from blocking the main body 140 of the nozzle 118.

The nozzle 118 forms an expansion chamber 134 just behind the inlet 128 into which the cartridge 108 may partially expand into and thereby burst by releasing the clip 116.

Figure 4:
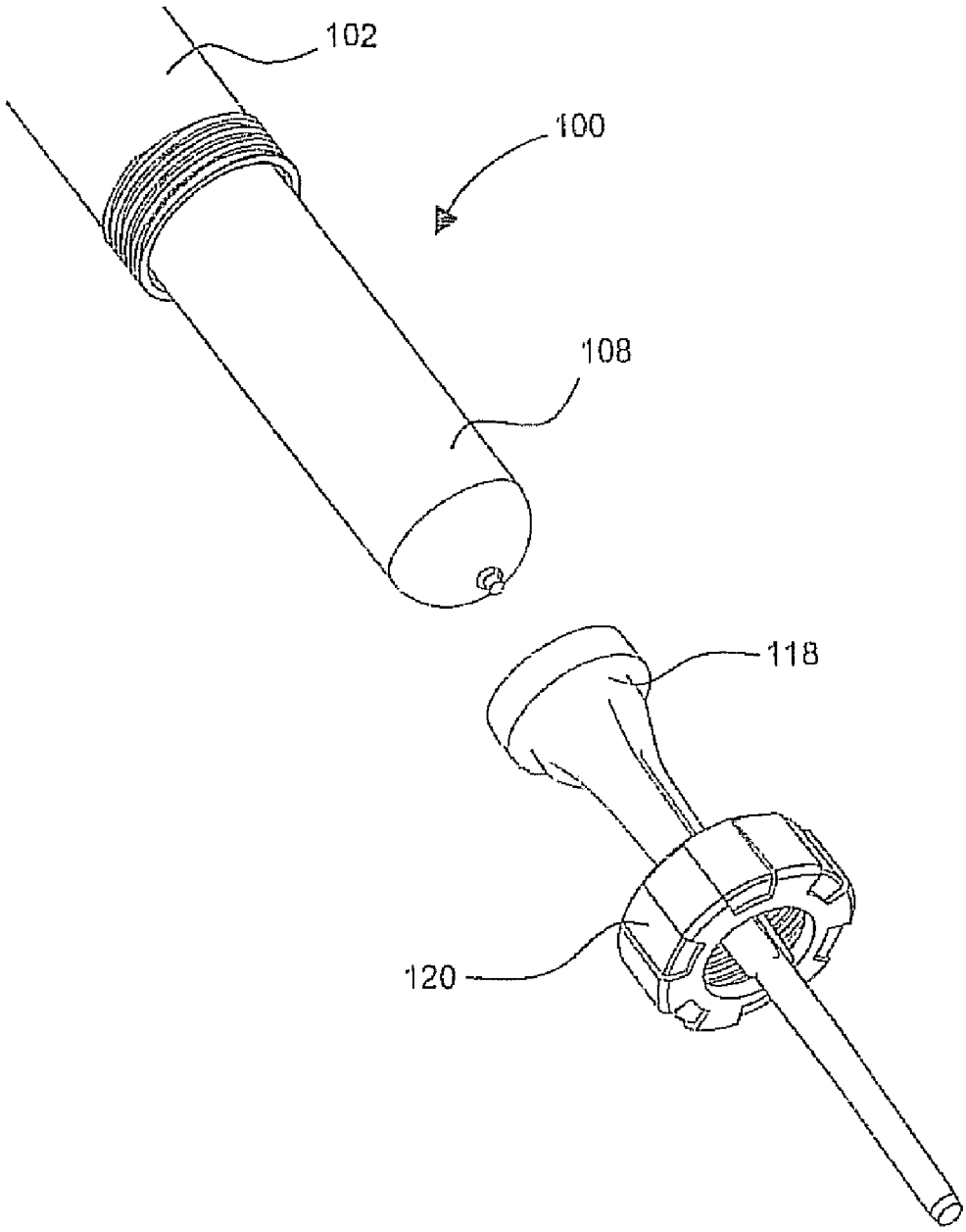
FIG. 4 is a schematic representation of the dispensing apparatus shown in FIG. 1 wherein a cartridge is partially inserted into a casing.

FIG. 4 shows the cartridge 108 being inserted into the casing 102. As shown, the cartridge 108 is snugly received into the casing 102. The casing 102 thereby substantially prevents the radial expansion of the cartridge 108 on application of pressure by a dispensing gun.

Figure 5:
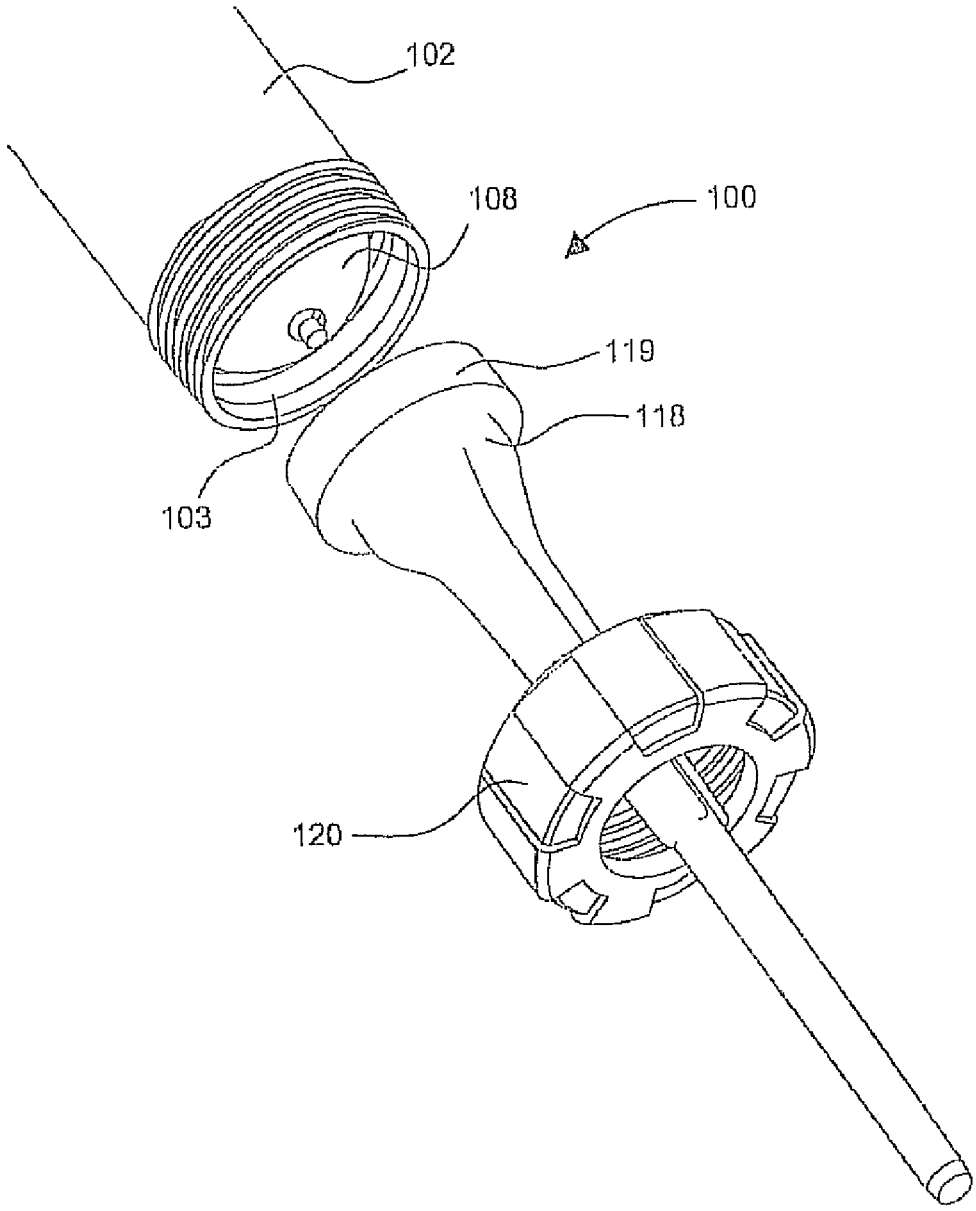
FIG. 5 is a representation of the dispensing apparatus shown in FIG. 1 wherein a cartridge is fully inserted into a casing.

FIG. 5 shows the cartridge 108 fully inserted into the casing 102.

Figure 6:
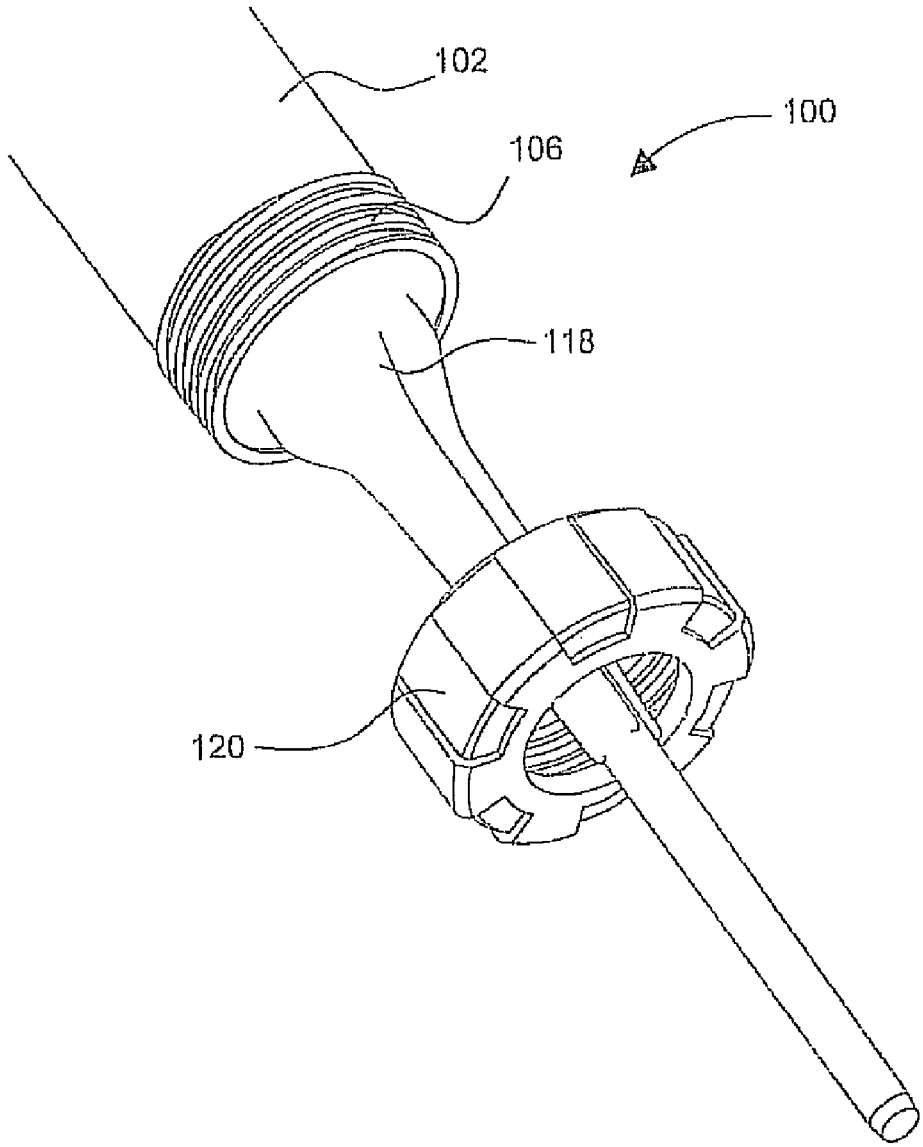
FIG. 6 is a schematic representation of the dispensing apparatus shown in FIG. 1 wherein a nozzle according to the present invention is attached to a casing.

FIG. 6 then shows the insertion of the nozzle 118 into the front of the casing 102. The outer rim 119 of the nozzle 118 fits inside the recessed portion 103 at the front of the casing 102. This may occur via a snap-fit arrangement. The nozzle 118 therefore forms a tight fit with the front of the casing 102. By fitting the nozzle 118 inside the casing 102 has the specific advantage of preventing spillage from the contents of the cartridge 108.

Figure 7:
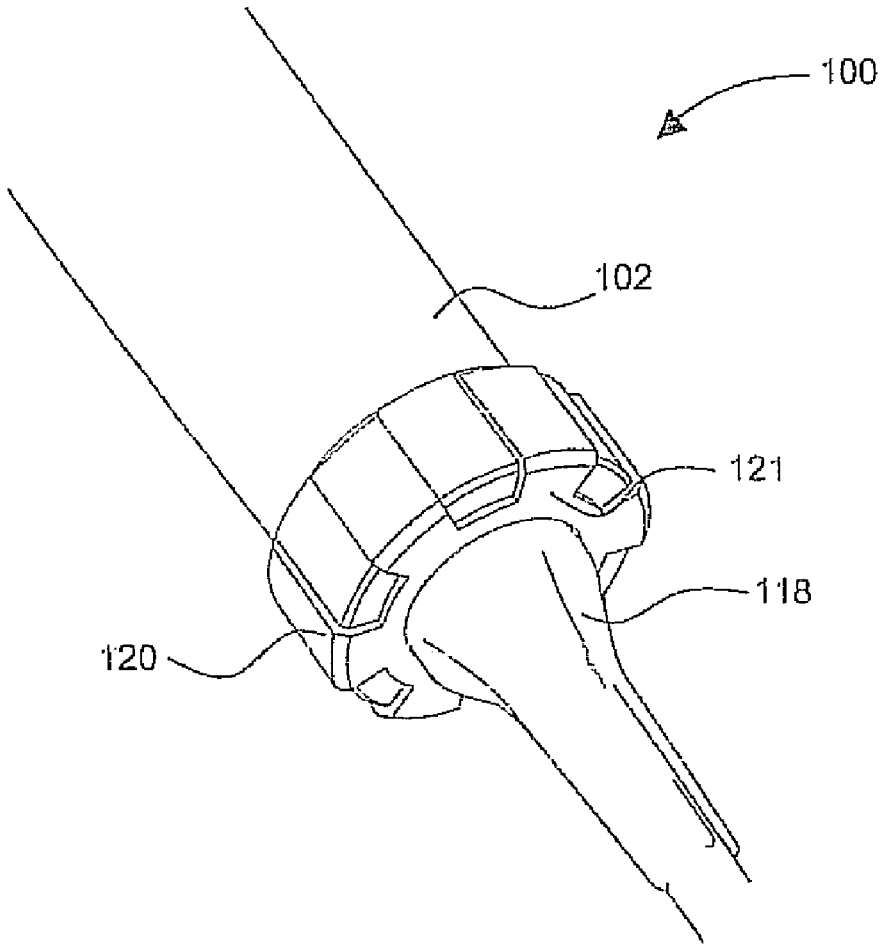
FIG. 7 is a schematic representation of the dispensing apparatus shown in FIG. 1 wherein a nozzle and securing nut according to the present invention is attached to a casing.

As shown in FIG. 7, the securing nut 120 is then screwed onto the thread 106 on the casing 102. The securing nut 120 has the function of securely retaining the nozzle 118 within the casing 102 as pressure is applied by a dispensing gun onto the back end of the cartridge 108. The flat annular section 121 of the securing nut 120 abuts and engages against the nozzle 118.

The cartridge 108 is snugly received within the casing 102. It is important to appreciate that the sides of the cartridge 108 are close to or abut against the inside surface 104 of the casing 102, therefore restricting any significant form of radial displacement. Furthermore, the cartridge 108 abuts against the flat annular section 133 in the nozzle 118 therefore preventing the cartridge 108 being displaced and travelling any further along the casing 102. The flat annular section 133 therefore acts as a reaction shoulder against the cartridge 108. Hydrostatic pressure may therefore be built up within the cartridge 108 by application of a dispensing gun until the clip 116 is forced off using pressure. The cartridge 108 partially expands into the expansion chamber 134 in the nozzle 118.

Figure 8:
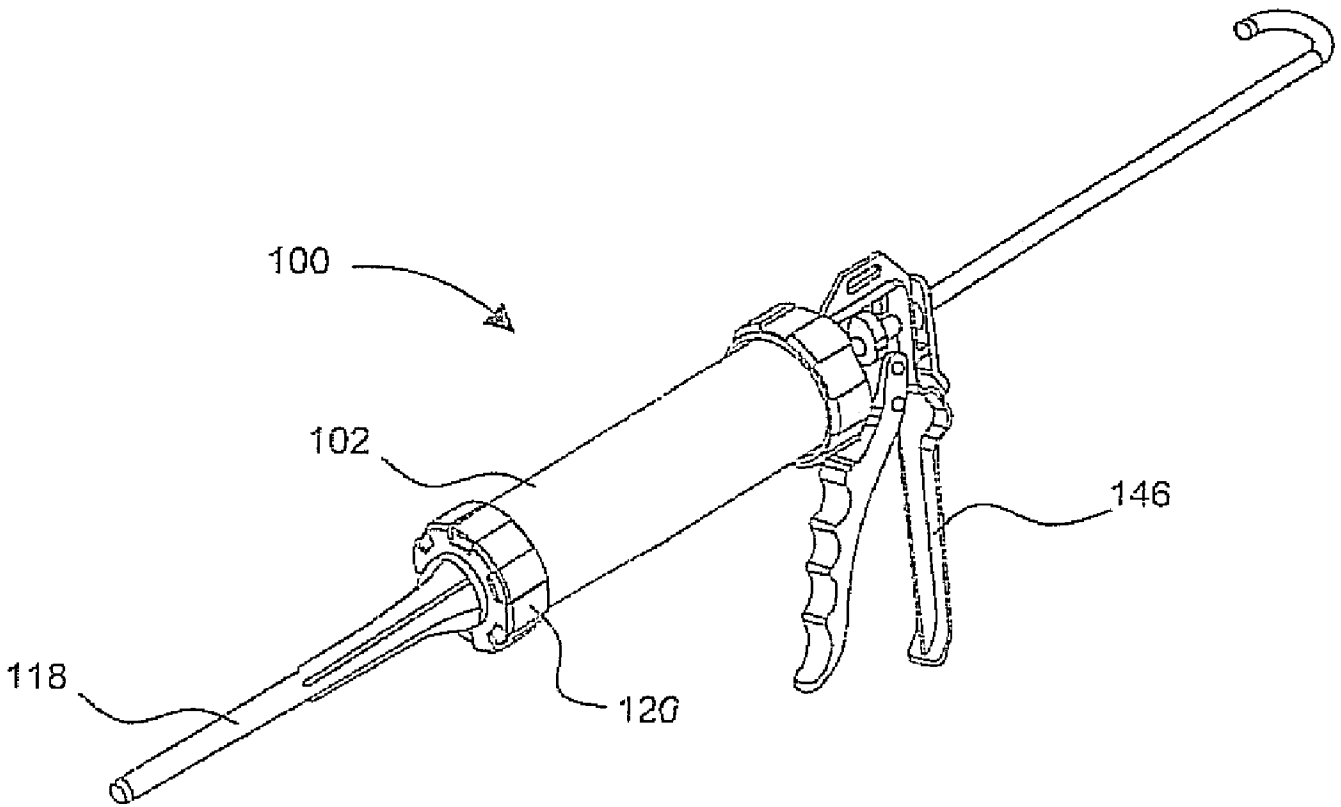
FIG. 8 is a schematic representation of dispensing apparatus according to the present invention attached to a dispensing gun.

FIG. 8 represents the dispensing apparatus 100 attached to a dispensing gun 146. Any suitable type of dispensing gun such as mastic gun may be used.

Figure 9:
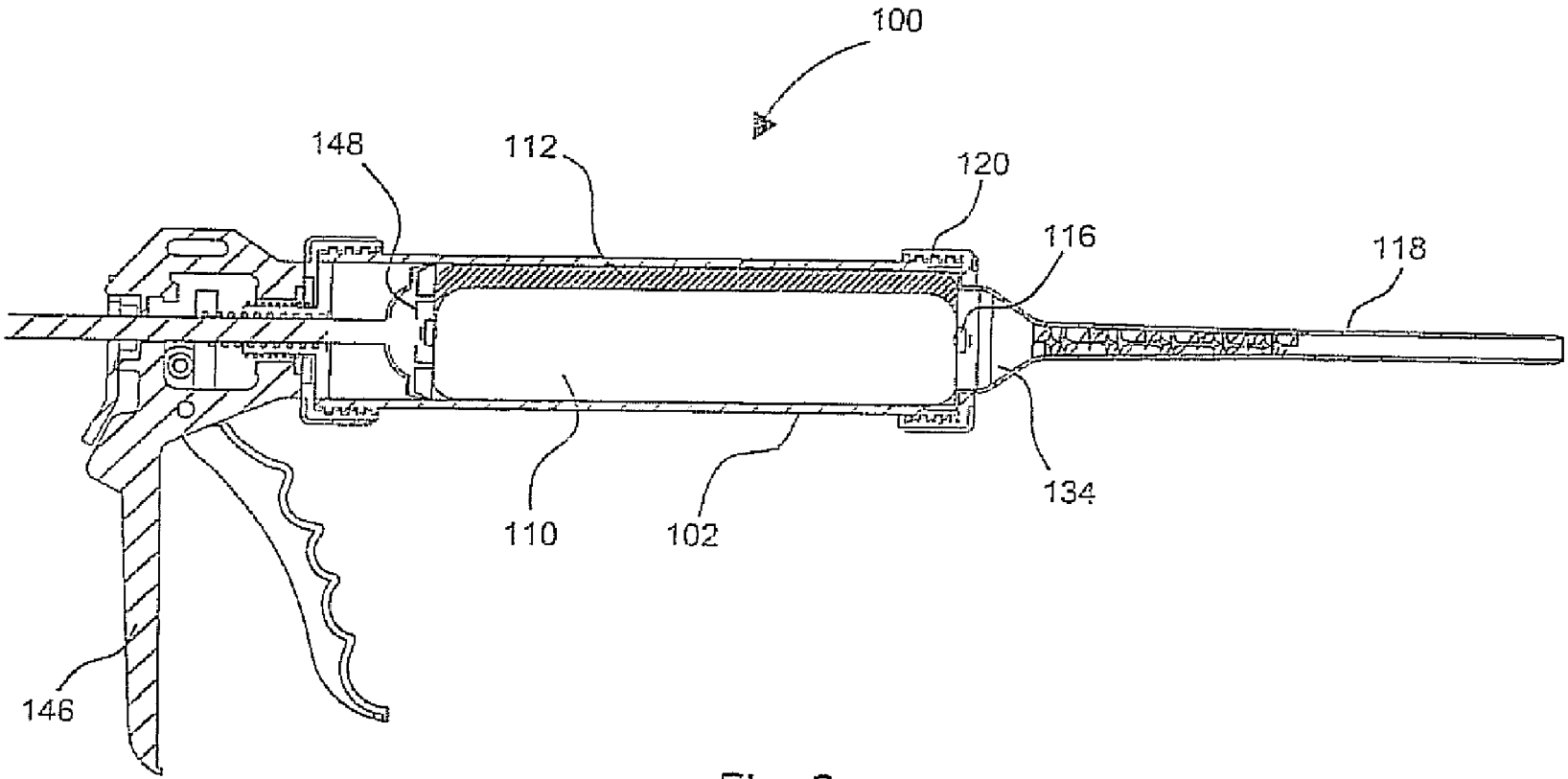
FIG. 9 is a side sectional representation of dispensing apparatus according to the present invention.

FIG. 9 is a schematic side sectional view of the apparatus 100 attached to the dispensing gun 146. As shown, the dispensing gun 146 comprises a back plate 148 which is capable of applying pressure to the cartridge 108. No pressure is being applied by the dispensing gun in the representation shown in FIG. 9. The cartridge 108 shown in FIG. 9 has two separate chambers 110,112. Chamber 110 contains compound A and chamber 112 contains compound B.

Figure 10:
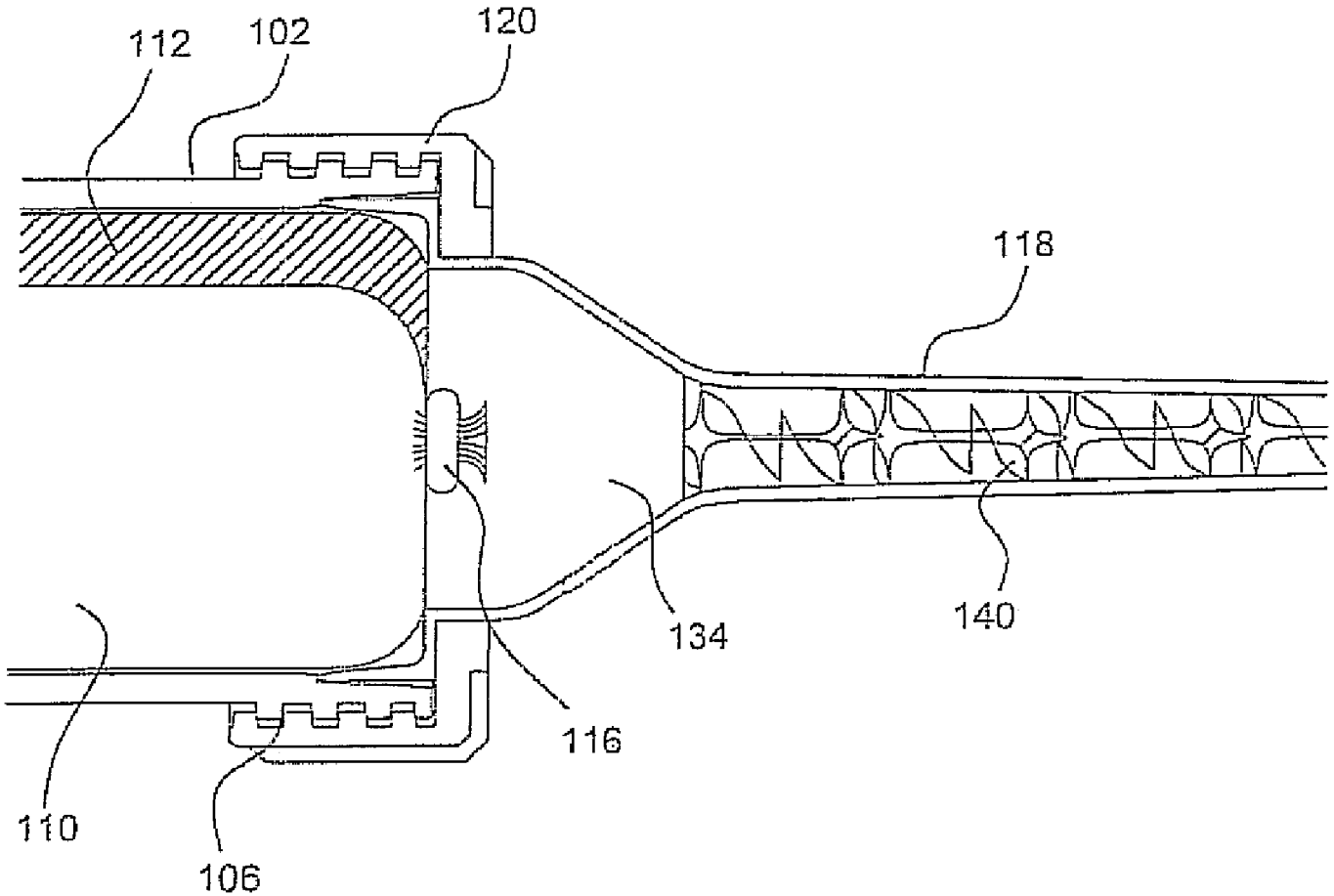
FIG. 10 is an expanded view of the front of the apparatus shown in FIG. 9.

FIG. 10 is an expanded view of the front of the apparatus 100 shown in FIG. 9. FIG. 10 shows the securing nut 120 attached to the threading 106 on the front of the casing 102.

Figure 11:
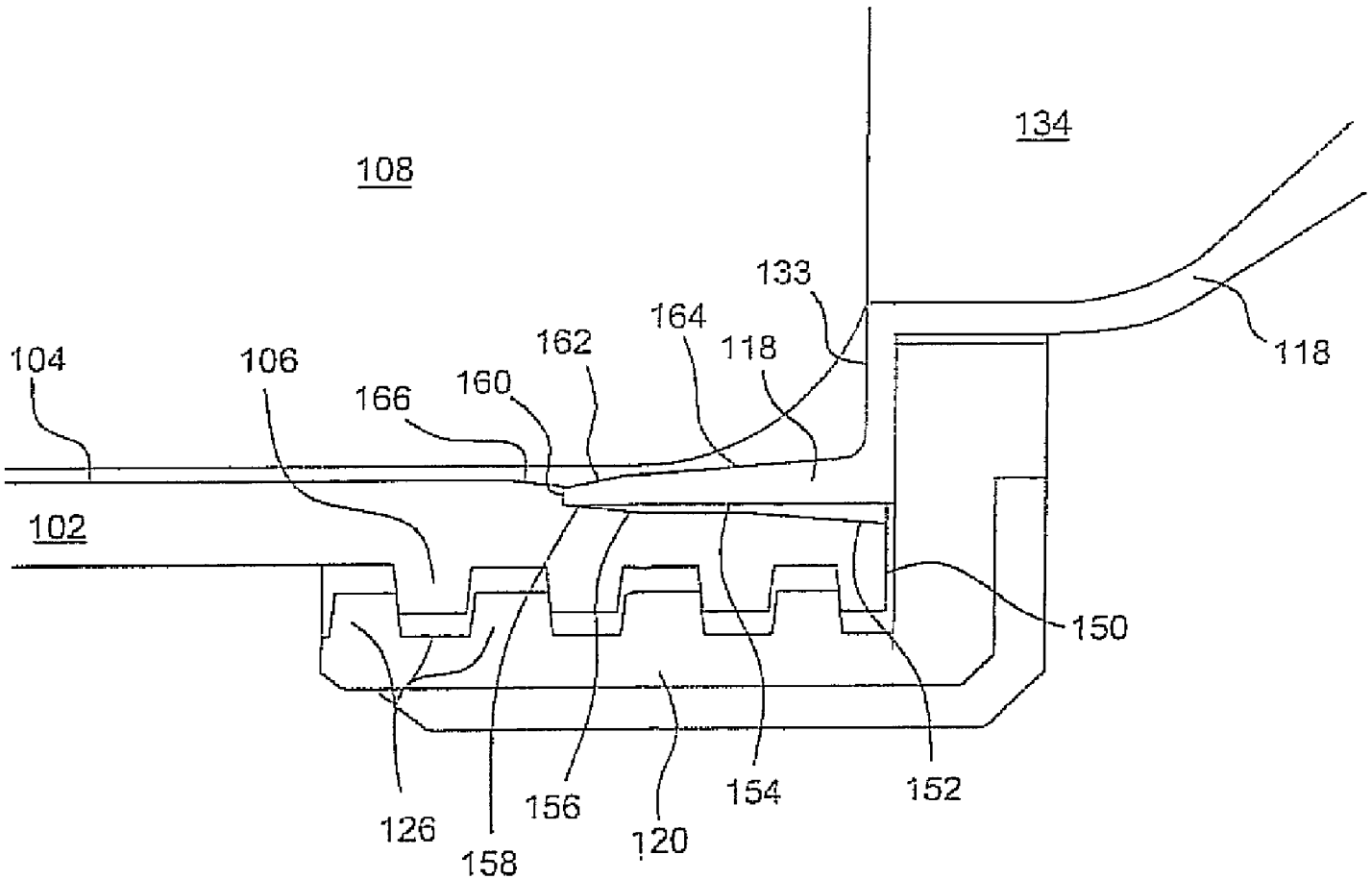
FIG. 11 is a further expanded view of the front of the dispensing apparatus shown in FIGS. 9 and 10.

FIG. 11 is an expanded view of the front of the apparatus 100 shown in FIG. 10. As shown therein, the thread 126 of the securing nut 120 is engaged with the thread 106 of the casing 102. The cartridge 108 is shown abutting against the flat annular section 133 of the nozzle 118. The flat annular section 133 therefore prevents the cartridge 108 being pushed along the inside surface 104 of the casing 102 on application of pressure by a dispensing gun 146. On application of pressure to the cartridge 108, the front of the cartridge 108 partially expands into the expansion chamber 134 whereupon hydrostatic pressure builds up within the cartridge 108. Once the hydrostatic pressure reaches a certain point, the clip 116 bursts off the end of the cartridge 108 thereby enabling the contents of the cartridge 108 to be dispensed. In the event that the cartridge 108 contains separate chambers 110,112, the release of the clip 116 has the advantage that different contents of the cartridge 108 such as compounds A and B may be substantially simultaneously mixed.

The casing 102 has a number of specific design features which are now explained. At the front of the casing 102, there is a small clearance 150 between tie end of the cartridge 102 and the securing nut 120. The clearance 150 facilitates tie securing of the nozzle 118 to the casing 102 by a clamping force. The front of the casing 102 also comprises a chamfered edge 152 which facilitates the insertion of the nozzle 118 into the casing 102. A location bore 154 is also formed in the casing 102 wherein a small clearance between the nozzle 118 and the casing 102 permits ease of assembly and disassembly. A further chamfered edge 156 also facilitates the insertion of the nozzle 118. An additional chamfer 158 is then also formed in the casing 102 to provide an additional seal with the nozzle 118. There is therefore a minimal interference fit around the rim of the nozzle 118. This facilitates the insertion and removal of the nozzle 118 and casing 102. The end face 160 of the nozzle 118 abuts and seals against the casing 102 thereby preventing ingress of any material leakage and contamination of the nozzle 118. At the end of the nozzle 118 there is also a small chamfer 162 which prevents a piston fouling and snagging on the rim of the nozzle 118. There is also a tapered surface 164 to facilitate the removal of the nozzle 118 when a cartridge 108 is only partially discharged. The tapered surface 164 prevents or at least minimises any dragging force occurring on the side of the cartridge 118. There is also a small chamfer 166 on the inside surface 104 of the casing 102 to facilitate the loading of the cartridge 108 into the casing 102.

Figure 12:
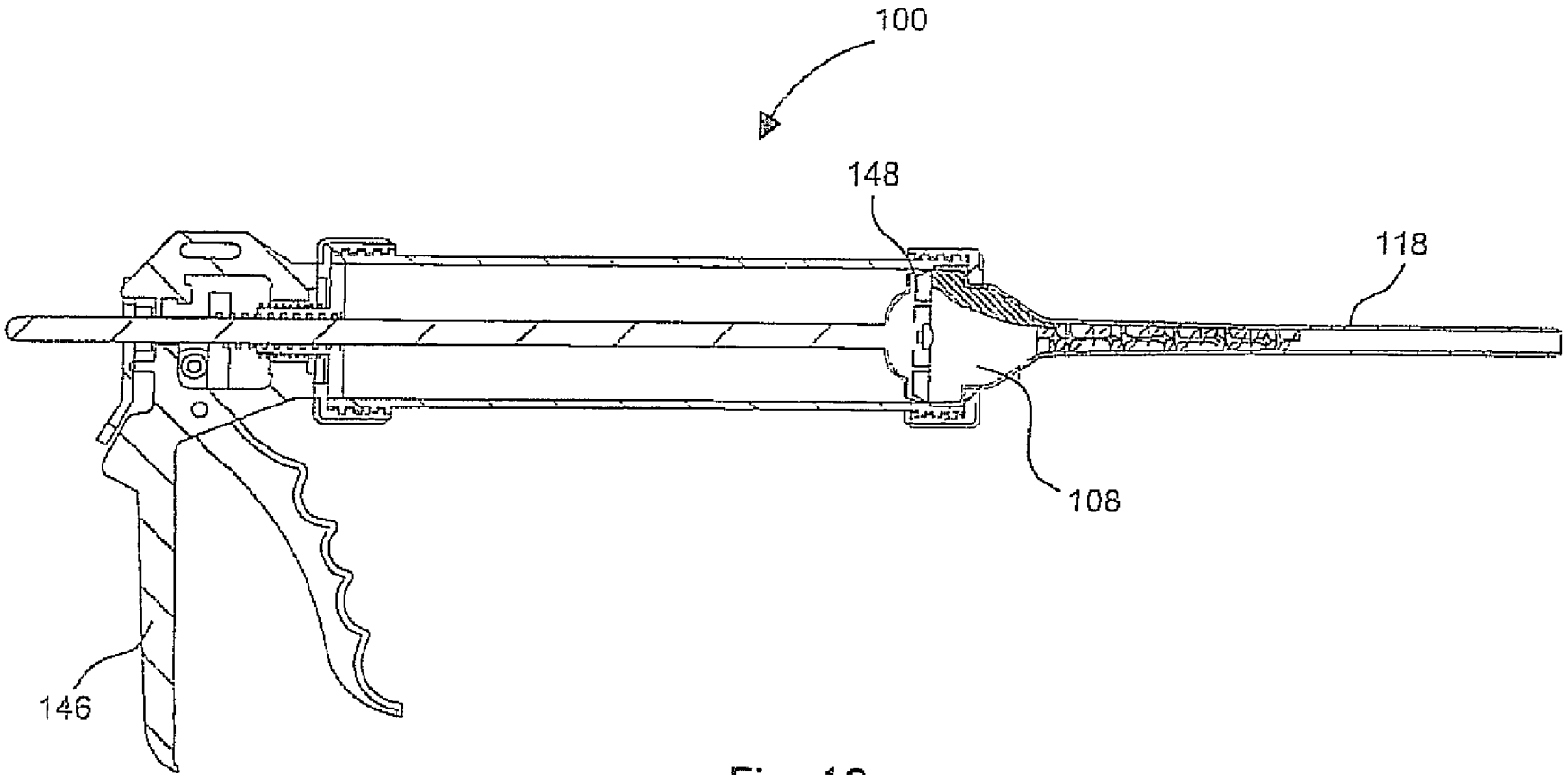
FIG. 12 is a schematic representation of dispensing apparatus according to the present invention wherein a cartridge is dispensed.

FIG. 12 is a representation where the dispensing gun 146 has been used to dispense the material from the cartridge 108.

Figure 13:
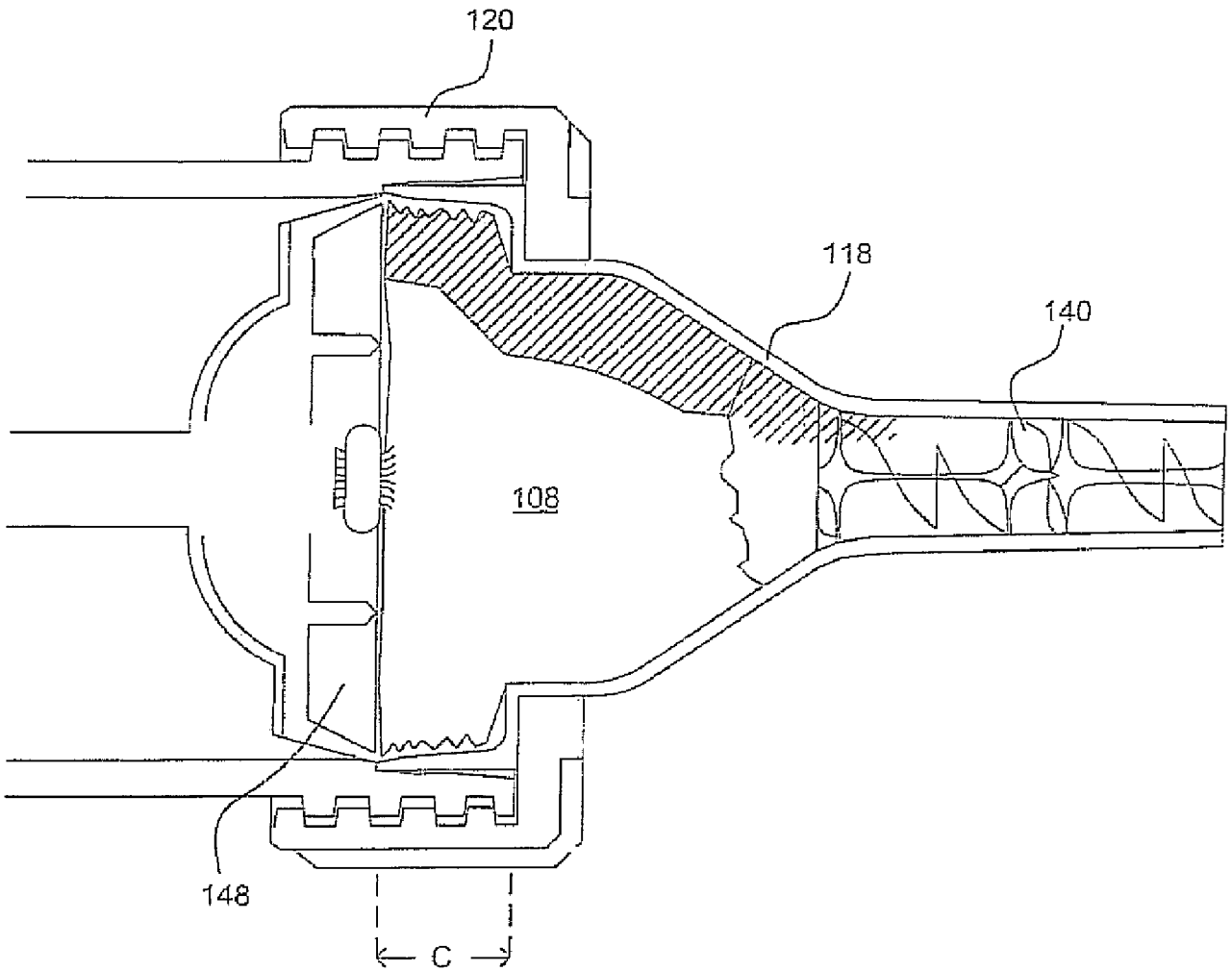
FIG. 13 is an expanded view of the front of the apparatus shown in FIG. 12.

FIG. 13 is an expanded view of the front part of the apparatus 100 shown in FIG. 12. The film of the cartridge 108 is shown to be compressed and/or crushed into the expansion chamber 134 and into the tapered section 132 of the nozzle 118. The tapering of section 132 is about 1-20° or preferably about 1-5° and has the specific function of retaining the compressed and/or crushed film once it has been compressed into the top end of the nozzle 118. The film may be fully or partially compressed into the top end of the nozzle and/or the expansion chamber 134. Once the contents of the cartridge 108 have been dispensed, the securing nut 120 may be removed from the front of tie casing 102. The nozzle 118 may then be removed from the front end of the casing 102 by applying some pulling force.

Figure 14:
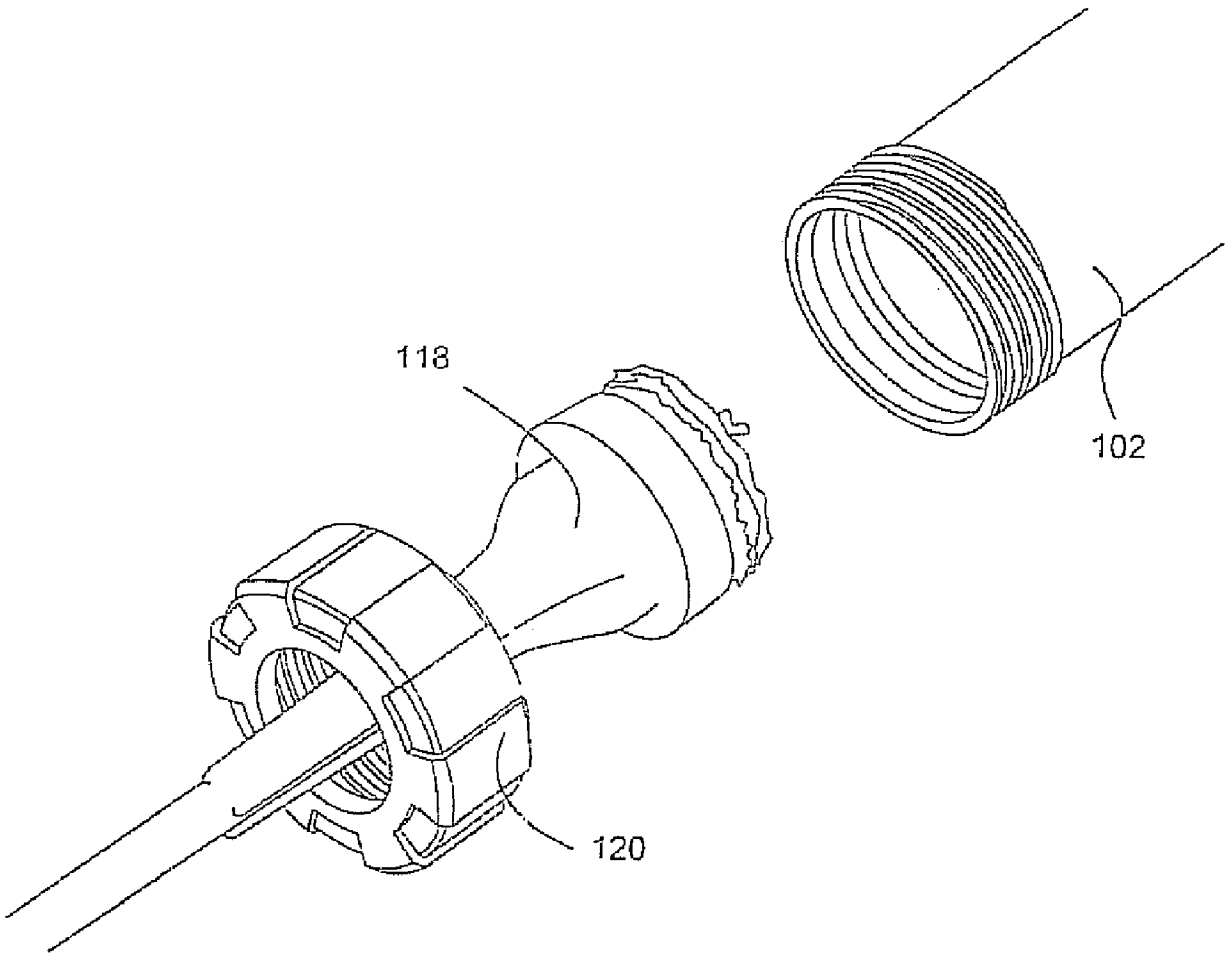
FIG. 14 is a schematic representation of the removal of a securing nut and nozzle from a casing once a cartridge is fully dispensed.

As shown in FIG. 14, the film forming the cartridge 108 is compressed into the front portion of the nozzle 118. The nozzle 118 containing the compressed cartridge 108 may therefore be thrown away and a new cartridge 108 inserted into the casing 102 for further use. The nozzle 118 is simple and easy to remove and is also adapted to simultaneously remove the compressed and/or crushed film forming the cartridge.

By removing the dispensed cartridge 108 in this manner prevents any spillage from occurring on the inside surface 104 of the casing 102. In the prior art when a casing became accidentally covered in dispensed material, users tend to throw away the cartridge.

Figure 15:
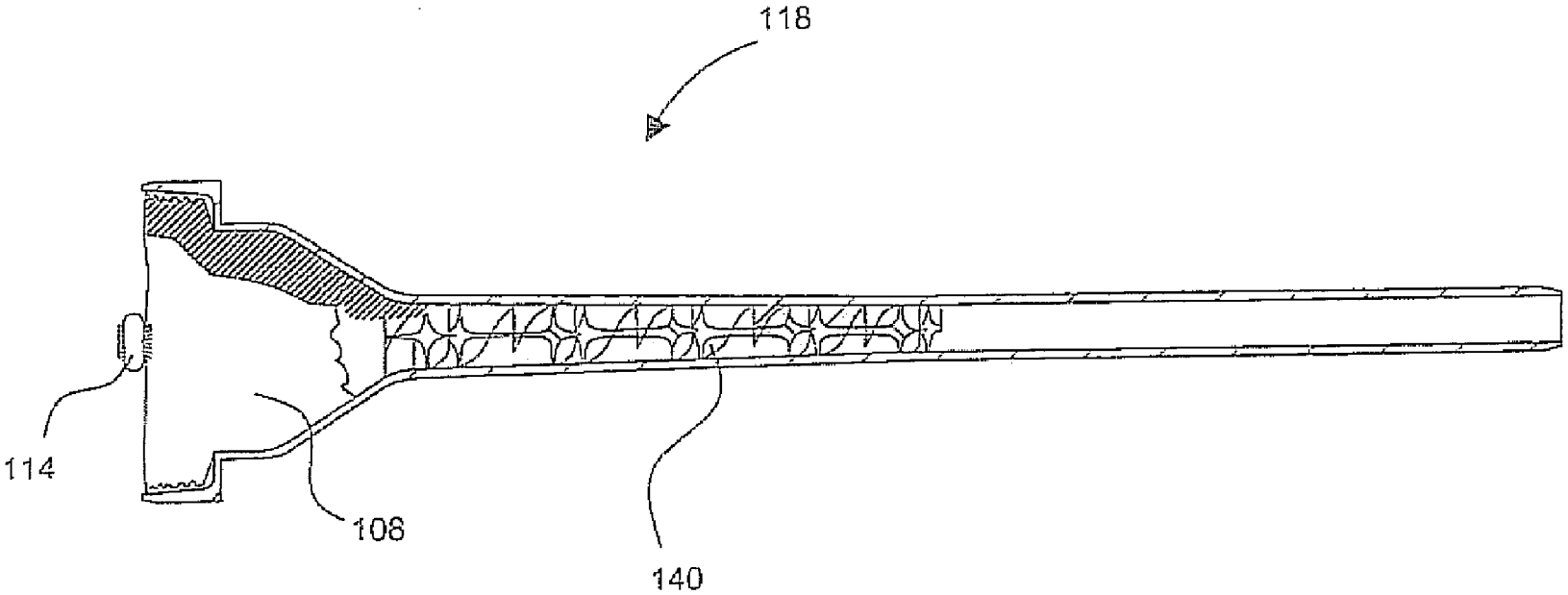
FIG. 15 is a sectional view of the nozzle shown in FIG. 14.

FIG. 15 is a sectional view of the nozzle 118 containing the compressed and/or crushed film forming the cartridge 108.

The nozzle 118 is also highly advantageous in situations where the contents of the cartridge 108 are only partially dispensed. When the required amount of material has been dispensed, the nozzle 118 can be removed as described previously with no contamination or spillage occurring on the inside surface 104 of the casing 102. This is a significant advantage as it allows the remaining content of the cartridge 108 to be dispensed and used at a later date with a replacement nozzle. The nozzle 118 may be replaced with a replacement nozzle as many times as necessary which is not possible with previous types of apparatus due to contamination and spillage occurring inside the casing 102. This is because the nozzle 118 fits inside the casing 102 and therefore prevents spillage.

Figure 16:
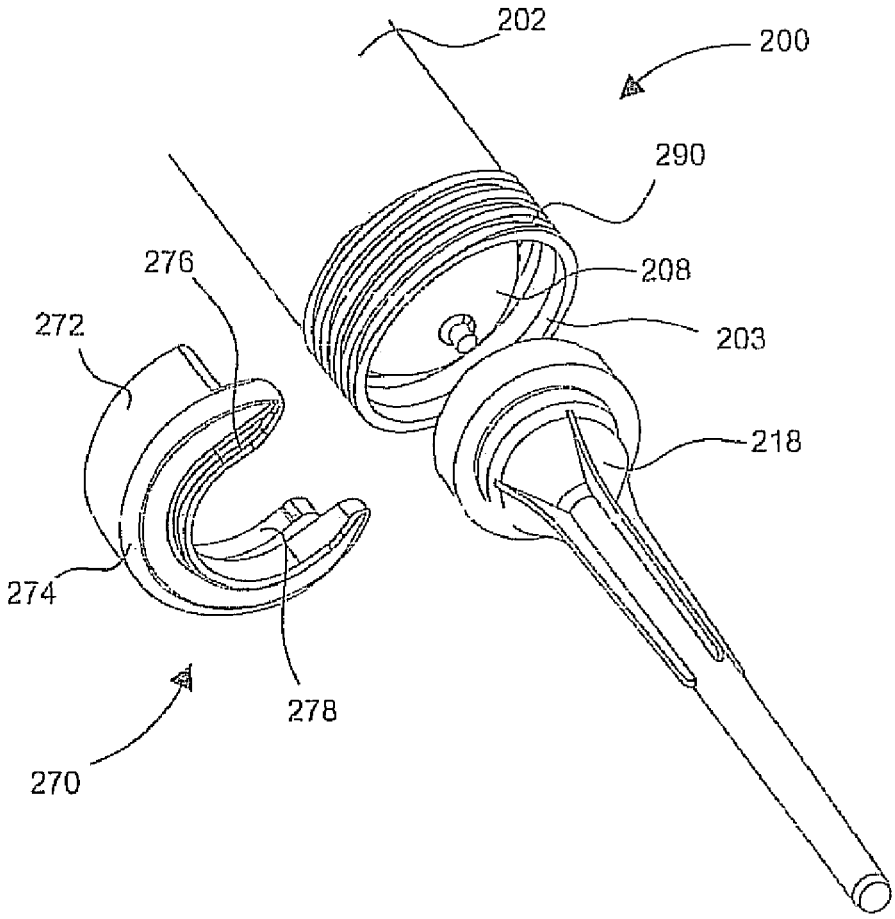
FIG. 16 is a schematic representation of dispensing apparatus according to a further embodiment of the present invention wherein a restraining clip and nozzle are shown.

FIG. 16 is a representation of apparatus, generally designated 200. Reference numerals with the prefix "2" similar to that used in FIGS. 1 to 15 are used. A restraining clip 270 is shown ready to be connected to the casing 202.

In FIG. 16, the cartridge 208 is fully inserted into the casing 202. The nozzle 218 is ready to be attached to the top end of the casing 202. First of all, the nozzle 218 is inserted into the recessed portion 203 at the top end of the casing 202. The restraining clip 270 is then snapped into a substantially circular groove 290 on the casing 202. The restraining clip 270 therefore is a snap-fit device which securely attaches itself to the casing 202.

Figure 17:
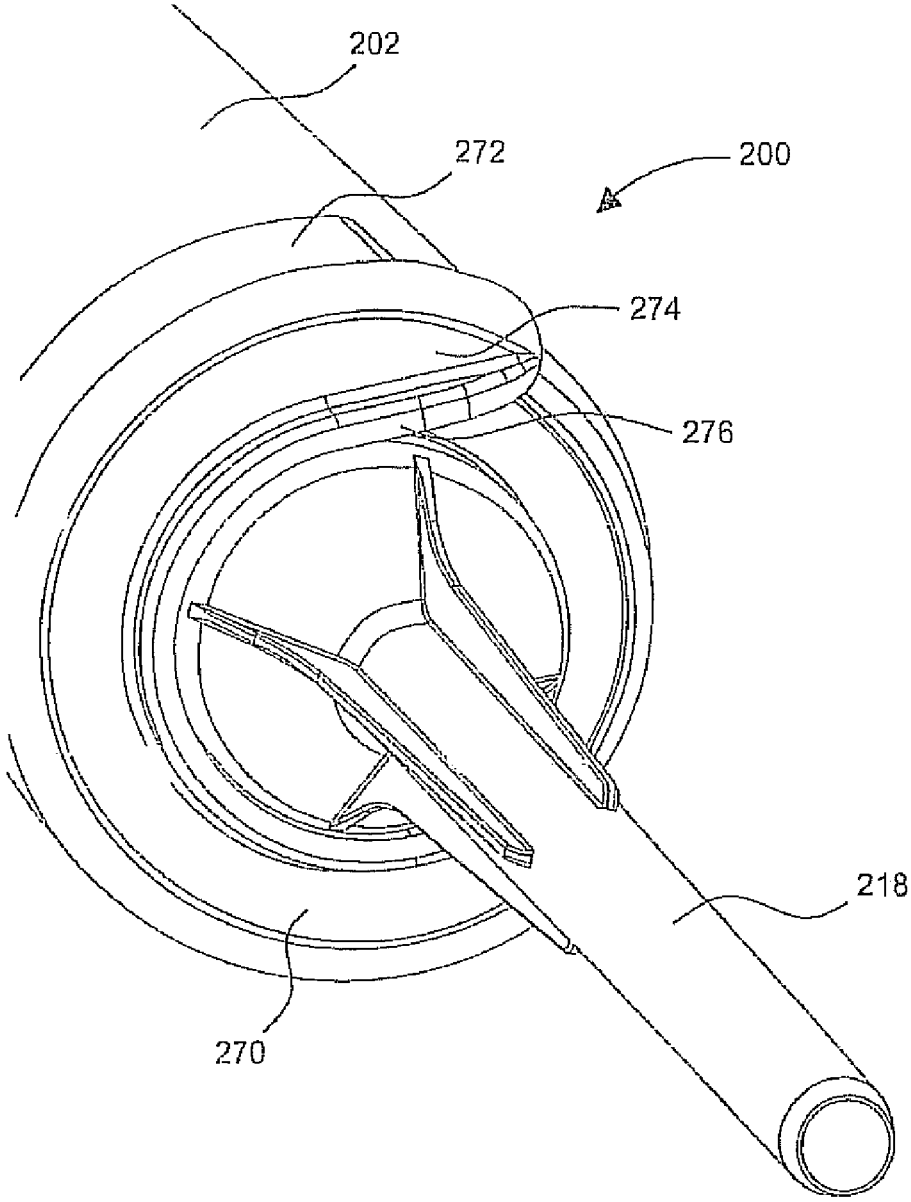
FIG. 17 is a representation of the dispensing apparatus shown in FIG. 16 with the nozzle and restraining clip attached.

FIG. 17 shows the restraining clip 270 holding the nozzle 218 in place at the top of the casing 202. The upper body section 274 of the restraining clip 270 is shown to fit over part of the nozzle 118 thereby securing the nozzle 118 firmly in place.

Figure 18:
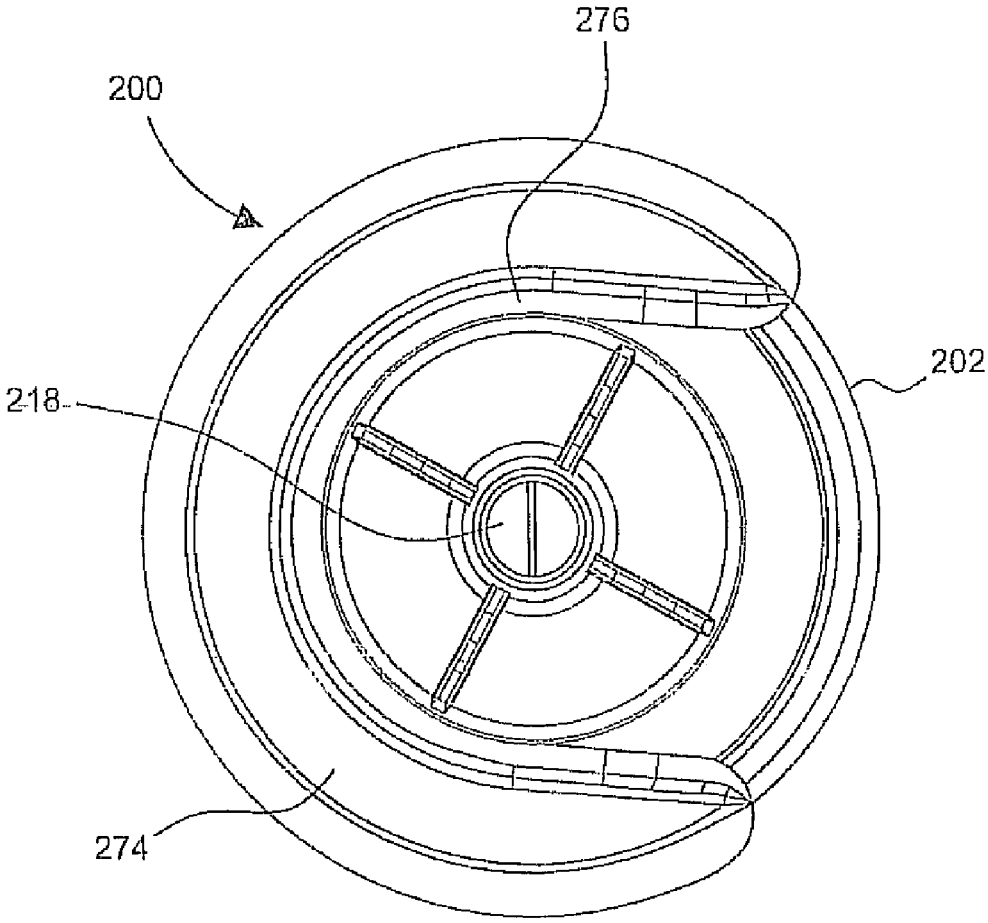
FIG. 18 is a front end view of the dispensing apparatus shown in FIG. 17.

FIG. 18 is a top end view showing the securing clip 270 attached to the casing 202.

The restraining clip 270 has a lower body section 272 and an upper body section 274. The restraining clip 270 also comprises a strengthening rib 276 which prevents deflection and/or distortion of part of the restraining clip 270 on application of pressure from a dispensing gun. Any suitable type or number of strengthening ribs 276 may be used.

Figure 19:
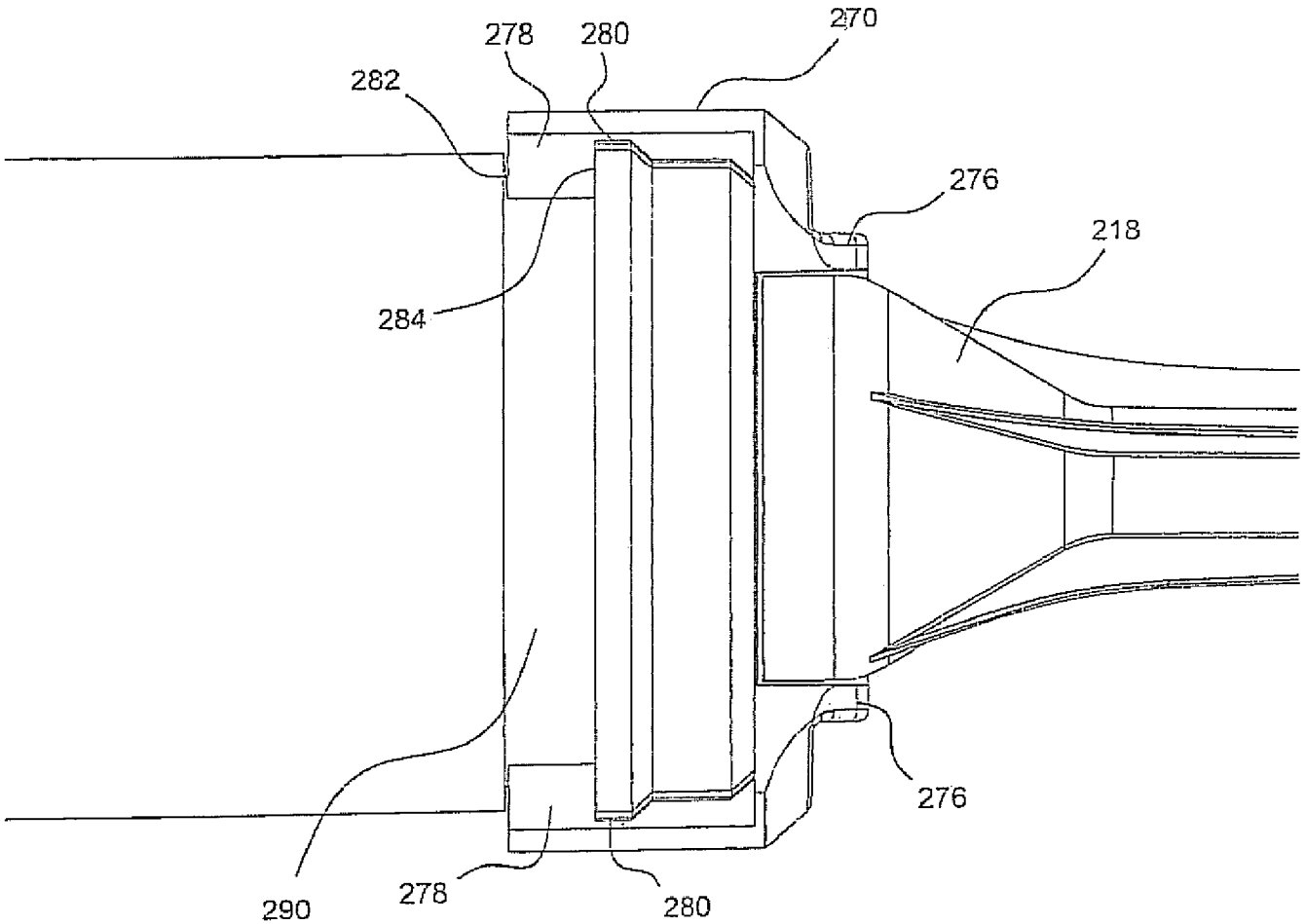
FIG. 19 is an expanded side view of the dispensing apparatus shown in FIGS. 17 and 18.

FIG. 19 is an expanded view showing the different structural features of the restraining clip 270 in attachment with the casing 202. The restraining clip 270 comprises a substantially annular shaped protrusion 278 which fits into the groove 290 on the casing 202. As shown in FIG. 19, the annular protrusion 278 forms a tight fit with the groove 290. The groove 290 on the cartridge 202 is deep enough to ensure positive engagement and to prevent any tendency for the restraining clip 270 to spring out under load. The restraining clip 270 also comprises a recess 280 which forms a further area of engagement with the casing 202. The mating faces 282,284 formed between the groove 290 and the annular protrusion 278 substantially eliminate any tendency for the restraining clip 270 to spring off under load. The deeper the groove 290, the more angular contact there is and therefore improved prevention of the restraining clip 270 springing off. The restraining clip 270 is engineered to minimise the high asymmetric loads it will experience under application from a dispensing gun. The strengthening rib 276 provides additional rigidity to the structure. The restraining clip 270 has a snap over feature to "lock" the restraining clip 270 and therefore nozzle 218 in place. The annular protrusion therefore preferably extends more than 180° around the casing 202 and preferably about 230°. Typically, the annular section formed by the annular protrusion 278 has a slightly smaller diameter than that formed by the groove 290. The annular protrusion 278 therefore grips the groove 290 and provides a secure attachment. On the outer surface of the restraining clip 270, there may be finger grips to facilitate the placement and removal of the restraining clip 270.

Figure 20C:
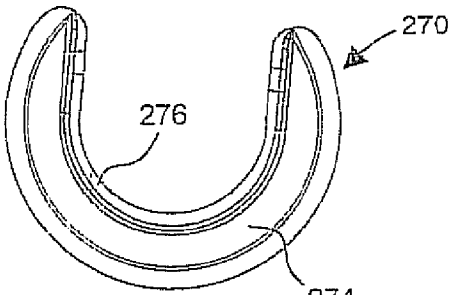
FIGS. 20*a*-20*d* are schematic representations of the restraining clip shown in FIGS. 16 to 19.
Figure 20D:
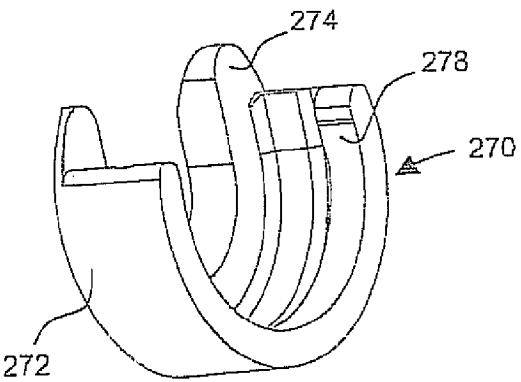
Figure 20A:
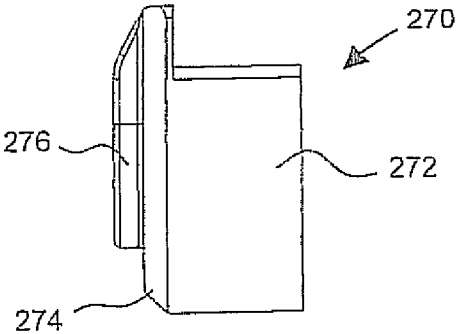
Figure 20B:
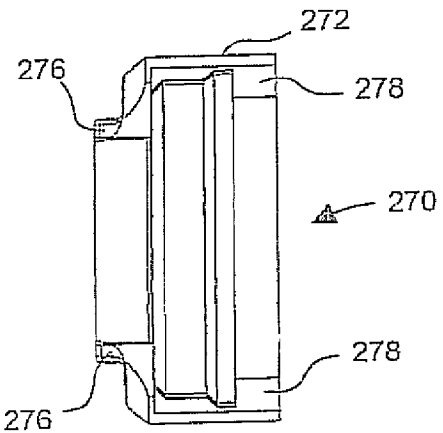

FIGS. 20*a* to 20*d* show different views of the restraining clip 270. FIG. 20*a* is a side view showing the lower body section 272, upper body section 274 and strengthening rib 276. FIG. 20*b* is a side sectional view showing the annular protrusion 278 and the strengthening rib 276. FIG. 20*c* is a top view of the restraining clip 270 and FIG. 20*d* is a perspective view showing the annular protrusion 278 which is used to attach the restraining clip 270 to the groove 290 in the casing 202.

Figure 21A:
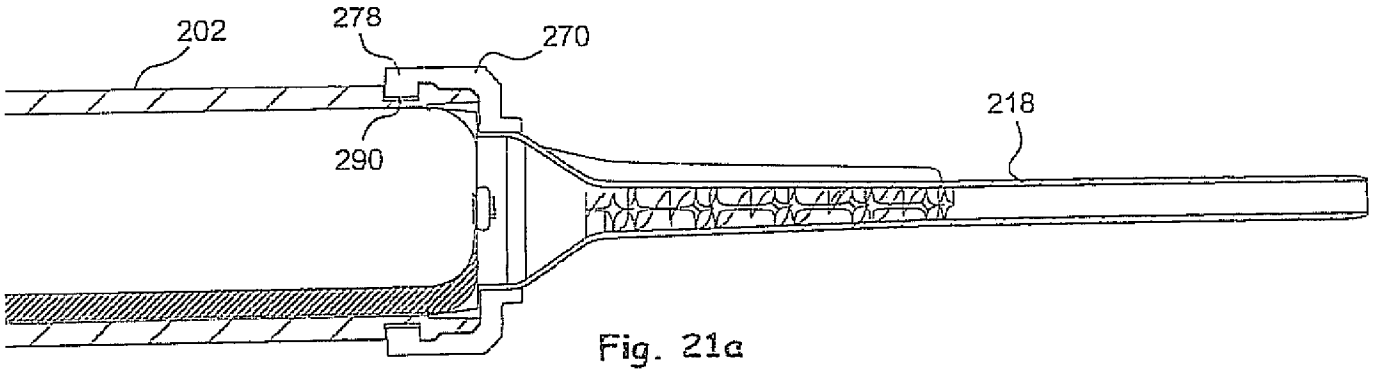
FIGS. 21*a*-21*b* are sectional side views of the dispensing apparatus shown in FIGS. 17 to 20*d;*
Figure 21B:
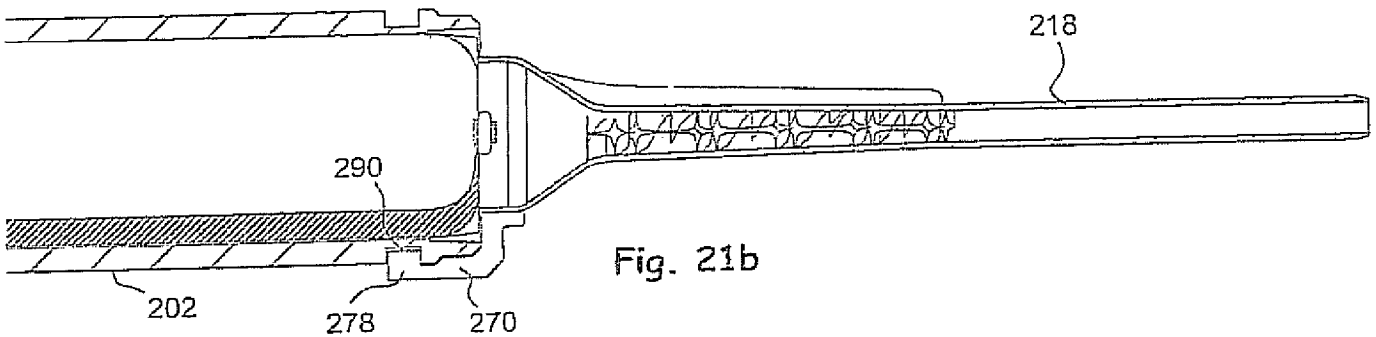

FIGS. 21*a* and 21*b* represent sectional views of the restraining clip 270 attached to the casing 202. FIG. 21*b* is a similar representation to that of FIG. 21*a* but rotated 90 degrees about the longitudinal length of the casing 202. Annular protrusion 278 is clearly shown as being inserted into the groove 290 on the casing 202.

Figure 22:
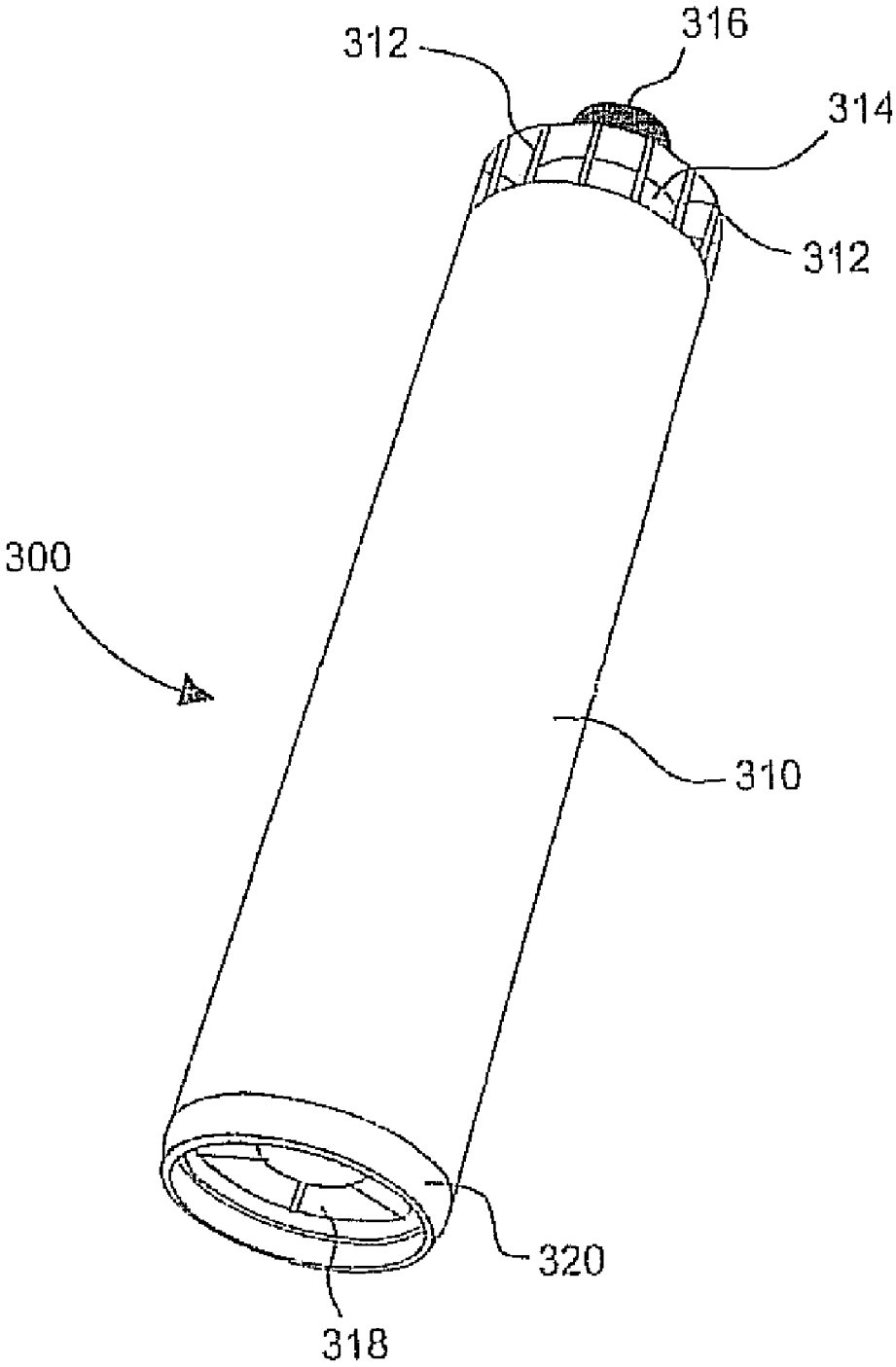
FIG. 22 is a perspective view of apparatus according to a further embodiment of present invention.

FIG. 22 shows a dispensing apparatus 300 comprising a cylindrical casing 310 which comprises moulded inserts 312, optionally in expansion chamber 314 and an outlet 316 at one end.

At the other end of the cylindrical casing 310, there is an inwardly distending member 320, extending around the circumferential end of the casing 310. The inwardly distending member 320 provides a reduced diameter at an end of the casing 310.

As shown in FIG. 22, a piston 318 is positioned in front of the inwardly distending member 320.

The cylindrical casing 310 is formed from any suitable plastics material which allows the inwardly distending member 320 to be formed by application of pressure to an end of the casing 310 to thereby crimp the end of the casing 310.

The moulded inserts 312 form the expansion chamber 114 into which a cartridge 322 may partially expand into prior to releasing the contents of the cartridge 222. Although not shown, the cylindrical casing 210 may also comprise a cap to securely seal the contents of the casing 310. The cap prevents any possibility of spillage during transit of the cylindrical casing 310.

Figure 23:
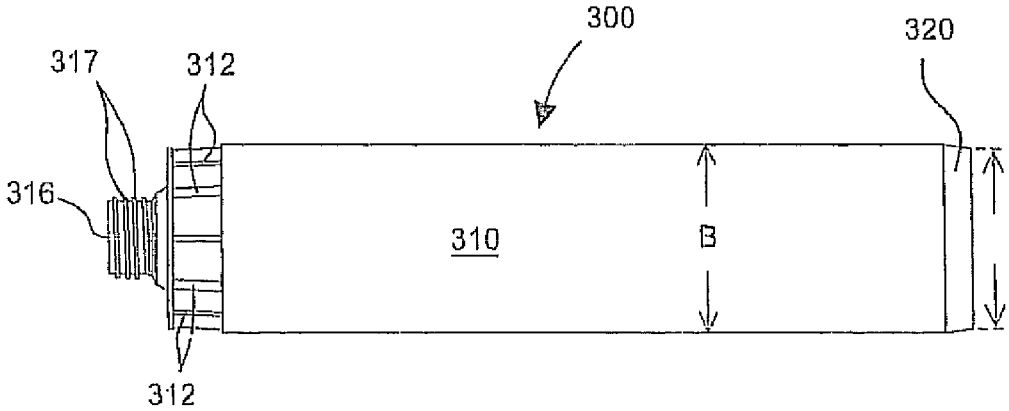
FIG. 23 is a side view of the apparatus as shown in FIG. 22.

FIG. 23 is a side view of the dispensing apparatus 300. FIG. 23 shows that the part of the cylindrical casing 110 comprising the inwardly distending member 320 has a reduced diameter. Diameter 'B' is therefore larger than diameter 'A'. At the other end of the cylindrical casing 310, the outlet 316 is shown to comprise a thread 317 onto which a cap to prevent leakage during transit may be attached or a dispensing nozzle (not shown) may be attached.

The difference between the diameter formed by the protruding member 320 identified by diameter 'A' and the diameter of the casing 310 identified by diameter 'B' is about 5 mm.

Figure 24:
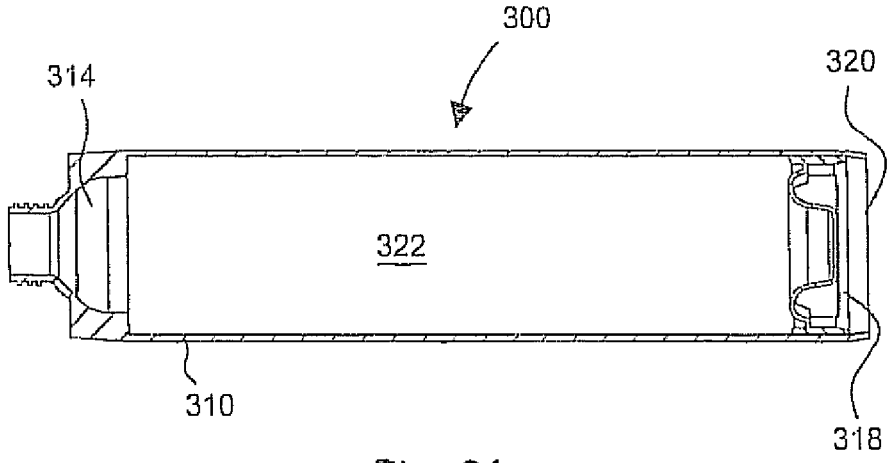
FIG. 24 is a sectional side view of the apparatus shown in FIGS. 22 and 23.

FIG. 24 is a sectional view of the apparatus 300 which shows that there is a cartridge 322 within the cylindrical casing 310. The cartridge 322 may be of any suitable form and may be a single or two-component cartridge. In embodiments where there is a two-component cartridge, there may be a single sealing means which may rupture thereby allowing the different components to mix substantially simultaneously. On application of pressure by the piston 318, the cartridge 322 may partially expand into the expansion chamber 314 prior to expelling the contents of the cartridge 322.

Figure 25:
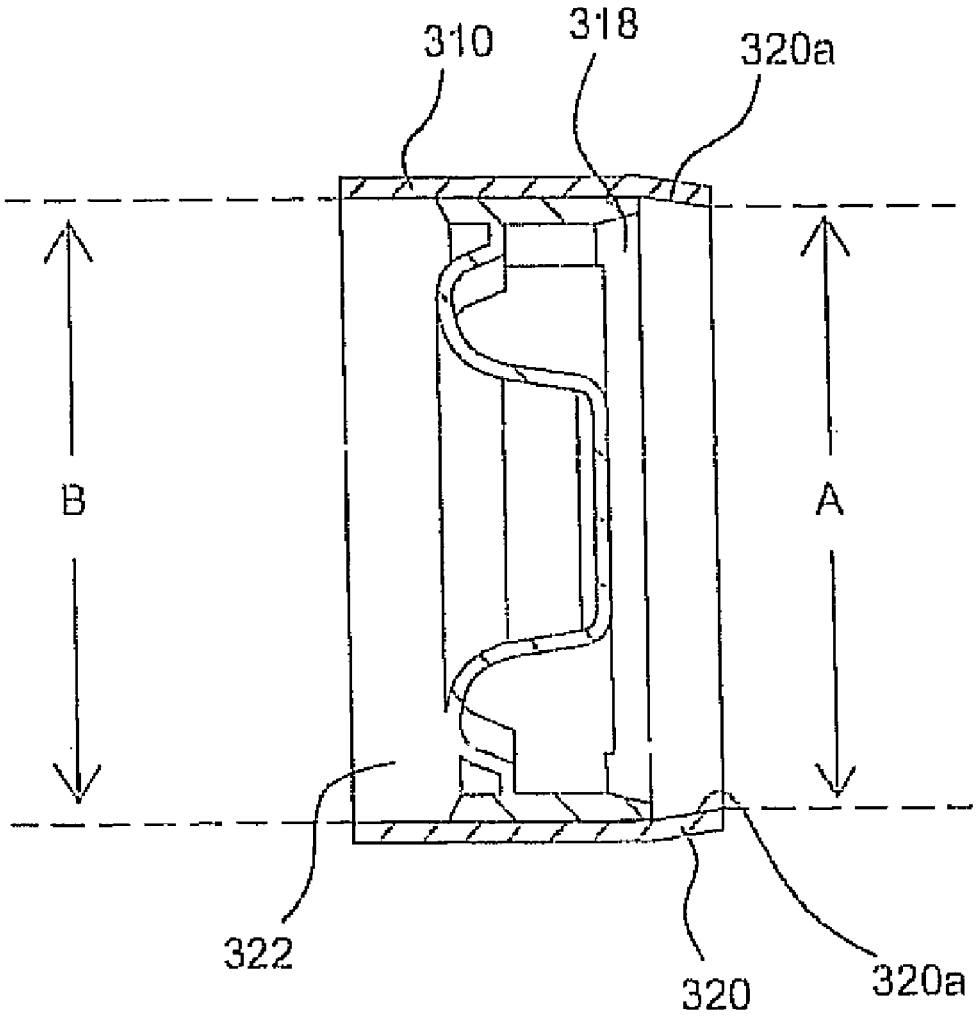
FIG. 25 is an enlarged view of an end of the apparatus shown in FIGS. 22-24.

FIG. 25 is an enlarged view of showing the indentation of the inwardly distending member 320*a*.

Figure 26A:
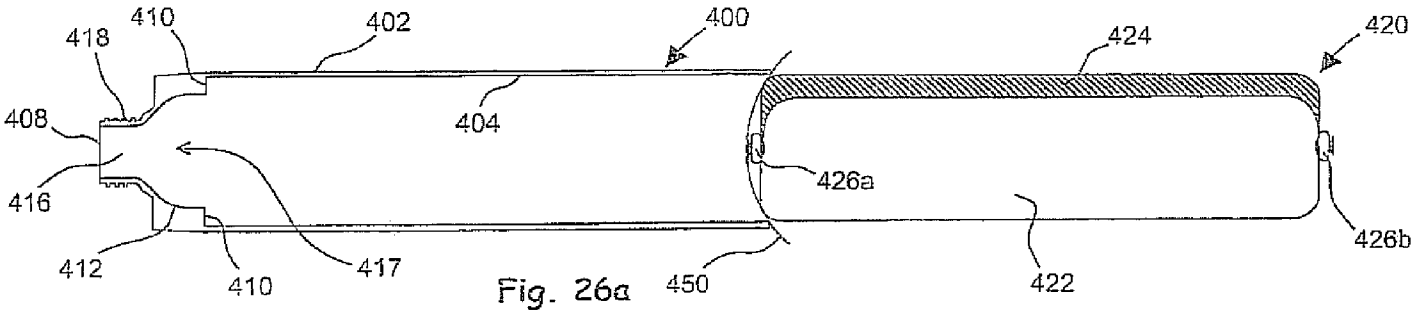
FIGS. 26A-26C are representations of dispensing apparatus according to a further embodiment of the present invention.
Figure 26B:
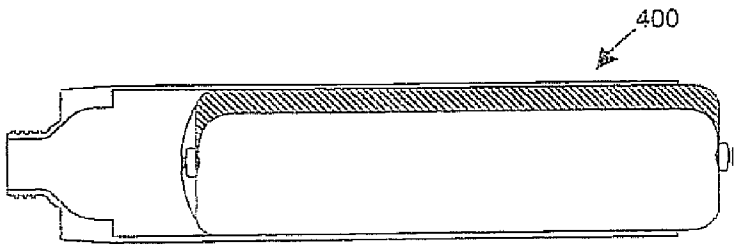
Figure 26C:
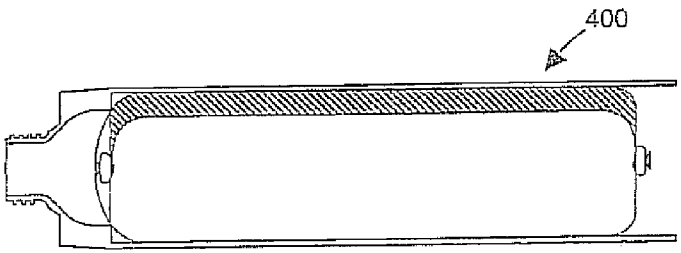
Figure 27:
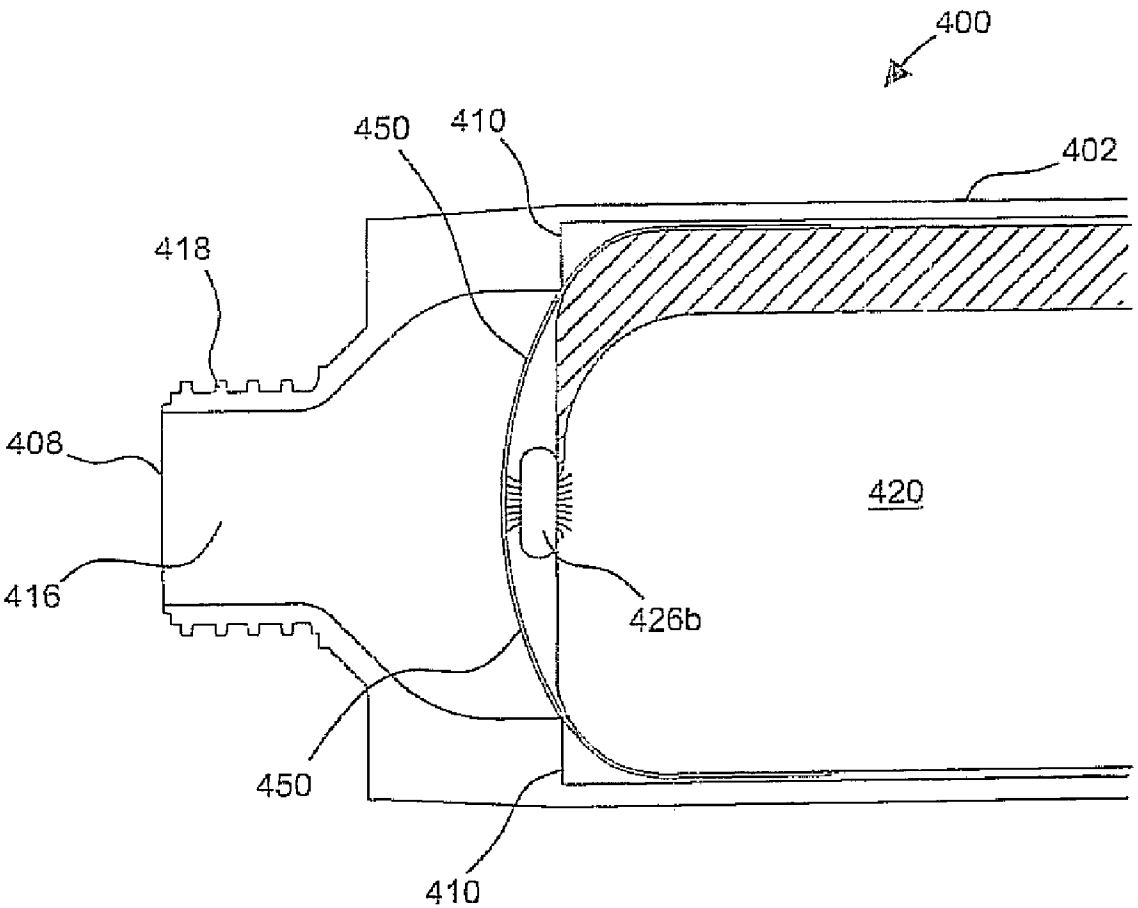
FIG. 27 is an enlarged view of the apparatus shown in FIG. 26C.

FIGS. 26A, 26B and 26C relate to dispensing apparatus according to the present invention, generally designated 400.

The apparatus 400 comprises a substantially rigid cylindrical hollow casing 402 which has an inner surface 404. The inner surface 404 of the casing 402 has a substantially tubular section which forms a wide opening 406 at a first end of the casing 402 and a narrower outlet 108 at a second end of the casing 402. Towards the second end of the casing 402, the diameter of the inner surface 404 of the casing 402 narrows, firstly via a shoulder 410, which then extends for a period along a substantially reduced concave diameter section 412. There is then a tubular section 416 of reduced diameter. Around the tubular section 416 there is a thread 418.

The region of the casing 402 extending between the shoulder 410 and the tubular section 416 may be termed an expansion chamber 417.

The cylindrical casing 402 is made from any suitable plastics or metal/alloy material.

As shown in FIG. 26A the cylindrical casing 402 is used to snugly receive a cartridge 420 which may be described as being 'sausage-like' in shape. The cartridge 120 comprises two separate chambers 422,424 which are secured to one another via adhesive means in the 'sausage-like' configuration. Chamber 422 contains compound A and chamber 424 contains compound B. The chambers 422,424 are sealed separate units.

The chambers 422,424 are formed from a thin material which has a limited degree of flexibility and expandability. However, the material is not too elastic otherwise the material will simply stretch on application of pressure. The material also has a high tear strength to prevent the cartridge 420 from inadvertently bursting open. The material is also specifically chosen so as to be inert towards the materials which they contain. The material may be made from any suitable plastics, polymer or metal foil material.

The ends of the cartridge 420 are closed with clips 426*a*, 426*b* once compounds A and B have been inserted into their respective chambers 422,424. Any suitable type of apparatus may be used to form the 'sausage-like' cartridge 420. For example, edible sausage making apparatus may be used. Clips 426*a*,426*b* are formed from relatively soft aluminium wire and are wound around the ends of the chambers 422,424 to prevent any leakage of compounds A and B during storage or initial placement in the casing 402. Careful attachment of the clips 426*a*, 426*b* is required so that any sharp ends formed by the clips 426*a*, 426*b* do not pierce the cartridge at any time during use of the dispensing apparatus 400.

FIG. 26A represents the situation where the cartridge 420 is ready to be inserted into the casing 402. Positioned in front of the cartridge 420 and over the opening 406 there is a support membrane 450. The support membrane 450 extends over the end of the cartridge 420.

As shown in FIG. 26B on insertion of the cartridge 420 into the casing 402, the support membrane 450 extends over the clip 426*a* and about 100 mm down the cartridge 420. The support membrane 450 also extends around the whole perimeter of the cartridge 420.

As the cartridge 420 is inserted into the casing 402, the support membrane 450 abuts against the inner surface 404 of the casing 402 and therefore provides some resistance for the cartridge 420 being inserted into the casing 402. The support membrane 450 provides an interference and crimping effect. Due to this application of pressure to 'force' the cartridge 420 into the casing 402, the cartridge 420 becomes pressurised (i.e. primed) due to the hydrostatic pressure caused by the forcing of the cartridge 420 into the casing 402. The cartridge 420 is therefore ready for use by a user.

FIG. 26C shows the cartridge 420 fully inserted into the casing 402.

The material forming the support membrane 450 is any suitable fabric-like material such as any form of absorbent paper which has a relatively low tear strength and is substantially inelastic.

The thickness of the support membrane 450 is chosen to provide a limited amount of resistance as the cartridge 420 is pressed into the casing 402. This process may be performed manually or automatically on a carousel. If the thickness of the support membrane 450 is too thick, this causes production difficulties as too much pressure is required to force the cartridge 420 into the casing 402.

In the embodiment shown in FIGS. 26A-26C and FIG. 27, the thickness of the support membrane 450 is about 0.2 mm. As the inside diameter of the casing 402 is about 47 mm and the diameter of the casing 420 is about 46.5 mm, the membrane covered cartridge 420 which has a diameter of about 46.9 mm forms a snug fit inside the casing 402. This snug fit provides the required interference and frictional resistance to apply some hydrostatic pressure and prime the cartridge 420 ready for use.

The tear strength of the support membrane 450 requires to be controlled to the degree that it does not impede the release of the clip 426*a* from the cartridge 420 under the action of pressure generated by the pumping of a mastic gun. The pumping load to release the clip 126*a* is about 20 to 40 kg. This pumping load is sufficiently high to result in the bursting of the support membrane 450.

The support membrane 450 is found to provide a degree of support to the front end of the cartridge 420. The support provided prevents the 'creeping' of the cartridge 420 into the expansion chamber 417 during transit or storage. This is important if the apparatus 100 is stored with the outlet 408 pointing down. The support membrane 450 is securely attached within the casing 402 by abutting against the inside surfaces 404 of the casing 402 and against the shoulders 410.

The support membrane 450 also has the function of acting as an absorbent and therefore minimising any leakage which may occur through the clips 426*a*, 426*b* of the cartridge 420.

The support membrane 450 also prevents a potential user and customer from viewing the clips 426*a*. It has been found in practice, that securing the contents of a cartridge 420 using clips 426*a* has resulted in users consciously trying to remove the clips 426*a* using pliers rather than appreciating that it is the hydrostatic pressure applied from a mastic gun which forces the clip 426*a* off.

Whilst specific embodiments of the invention have been described above, it will be appreciated that departures from the described embodiments may still fall within the scope of the invention. For example, any suitable type of securing member may be used to attach the nozzle to the casing. For example, any suitable shaped device either fully encompassing or attaching via a snap-fit arrangement may be used to attach the nozzle to the casing. The attachment member may be either separately formed or integrally formed with either the casing or the nozzle arrangement. Additionally, the cartridge used in the apparatus may have any number of different chambers and different sized cartridges may also be used. Additionally, any suitable type of sealing means may be used to close the ends of the cartridge. Furthermore, the sealing means may be attached relatively loosely meaning that only a minimum amount of pressure needs to be applied to force the sealing means off the cartridge.

The invention claimed is:

1. Apparatus for storing and dispensing a product, the apparatus comprising:

a substantially rigid outer casing;

a cartridge capable of being fitted inside the substantially rigid outer casing;

a nozzle; and a locking member capable of securely attaching the nozzle to the substantially rigid outer casing;

wherein the cartridge is at least partially covered with a support membrane which is capable of providing resistance due to interference and/or crimping between the support membrane and an inside surface of the rigid outer casing whereby due to pressure applied to an end of the cartridge during insertion, hydrostatic pressure may be built UP inside the cartridge.

2. Apparatus according to claim 1, wherein an end of the nozzle is adapted to fit and be secured inside the substantially rigid outer casing.

3. Apparatus according to claim 1, wherein an end of the nozzle is adapted to fit inside a substantially circumferential recess in the substantially rigid outer casing.

4. Apparatus according to claim 1, wherein the locking member abuts and engages against the nozzle, thereby securing the nozzle in place.

5. Apparatus according to claim 1, wherein the locking member is capable of being fitted via a snap-fit or threaded screw arrangement.

6. Apparatus according to claim 1, wherein the locking member is in a substantially horse-shoe or 'U'-shaped arrangement which is capable of clipping over the nozzle.

7. Apparatus according to claim 1, wherein the locking member is adapted to prevent the nozzle springing off on application of pressure to the cartridge.

8. Apparatus according to claim 1, wherein the locking member is capable of being either unscrewed or released via a snap-fit arrangement to the casing at any time during the dispensing of the cartridge contents.

9. Apparatus according to claim 1, wherein the nozzle comprises a recess into which the cartridge is capable of being fully or at least partially compressed into.

10. Apparatus according to claim 9, wherein the recess in the nozzle is tapered in shape which securely retains film forming the cartridge which is compressed into the nozzle.

11. Apparatus according to claim 1, wherein the substantially rigid outer casing is capable of being adapted to receive the cartridge and the cartridge comprises a weakened area capable of rupturing when pressure is applied to the cartridge.

12. Apparatus according to claim 1, wherein the casing comprises an inwardly distending member capable of engaging and acting as a stop to prevent a piston member from falling out.

13. Apparatus according to claim 12, wherein the inwardly distending member is substantially inwardly directed towards the centre of the casing and is capable of engaging and/or snagging a piston member and thereby preventing the piston member from falling out of the casing.

14. Apparatus according to claim 12, wherein the inwardly distending member reduces the diameter of the casing and is capable of acting as a stop against a piston member.

* * * * *